US009158259B2

(12) United States Patent
Yoshida

(10) Patent No.: US 9,158,259 B2
(45) Date of Patent: Oct. 13, 2015

(54) IMAGE PROCESSING APPARATUS

(75) Inventor: Toshiyuki Yoshida, Fukushima (JP)

(73) Assignee: OKI DATA CORPORATION, Tokyo (JP)

( * ) Notice: Subject to any disclaimer, the term of this patent is extended or adjusted under 35 U.S.C. 154(b) by 652 days.

(21) Appl. No.: 12/923,193

(22) Filed: Sep. 8, 2010

(65) Prior Publication Data

US 2011/0064505 A1 Mar. 17, 2011

(30) Foreign Application Priority Data

Sep. 11, 2009 (JP) ..... 2009-210135

(51) Int. Cl.
*G03G 15/00* (2006.01)

(52) U.S. Cl.
CPC ..... *G03G 15/6502* (2013.01); *G03G 15/6564* (2013.01); *G03G 2215/00603* (2013.01)

(58) Field of Classification Search
CPC ..... G03G 15/505; G03G 15/6564; G03G 2215/00599; G03G 15/6502; G03G 2215/00603
USPC ..... 399/391, 388, 76; 271/9.01
See application file for complete search history.

(56) References Cited

U.S. PATENT DOCUMENTS

| | | | | |
|---|---|---|---|---|
| 5,797,080 | A * | 8/1998 | Okamoto | 399/391 |
| 5,960,234 | A * | 9/1999 | Shibaki et al. | 399/75 |
| 2001/0053300 | A1 * | 12/2001 | Endo et al. | 399/394 |
| 2005/0253886 | A1 * | 11/2005 | Nakajima et al. | 347/16 |
| 2008/0075490 | A1 * | 3/2008 | Ota et al. | 399/45 |
| 2008/0260444 | A1 * | 10/2008 | Ikeda | 399/388 |

FOREIGN PATENT DOCUMENTS

| | | | |
|---|---|---|---|
| JP | 09-311606 | | 12/1997 |
| JP | 10-039694 | A | 2/1998 |
| JP | 2002-118700 | A | 4/2002 |
| JP | 2006-243285 | A | 9/2006 |
| JP | 2007-193268 | A | 8/2007 |
| JP | 2007-286513 | A | 11/2007 |
| JP | 2008-216816 | A | 9/2008 |
| JP | 2009-116105 | A | 5/2009 |

* cited by examiner

*Primary Examiner* — Matthew G Marini
(74) *Attorney, Agent, or Firm* — Rabin & Berdo, P.C.

(57) ABSTRACT

An image processing apparatus includes a plurality of medium storage portions, a medium feeding unit that feeds a medium from any one of the medium storage portions, an image forming unit that performs image formation to thereby form an image on the medium fed by the medium feeding unit, a storage unit that stores an image formation waiting time after the medium feeding unit starts feeding the medium from the medium storage portion and before the image forming unit starts the image formation, and a control unit that causes the image forming unit to wait for a time interval based on the image formation waiting time, after the medium feeding unit starts feeding the medium.

25 Claims, 24 Drawing Sheets

| TRAY NO. | MEDIUM FEEDING WAITING TIME (sec) | IMAGE FORMATION WAITING TIME (sec) |
|---|---|---|
| MPT | 3 | 0 |
| TRAY1 | 1 | 0 |
| TRAY2 | 0 | 2 |
| TRAY3 | 0 | 3 |
| TRAY4 | 0 | 4 |
| TRAY5 | 0 | 5 |

| TRAY NO. | SIZE | ORIENTATION | STORAGE AMOUNT (%) |
|---|---|---|---|
| MPT | – | – | – |
| TRAY1 | A4 | VERTICAL | 80 |
| TRAY2 | A4 | HORIZONTAL | 20 |
| TRAY3 | B5 | VERTICAL | 50 |
| TRAY4 | B4 | VERTICAL | 0 |
| TRAY5 | A3 | VERTICAL | 50 |

| TRAY NO. | MEDIUM FEEDING WAITING TIME (sec) | IMAGE FORMATION WAITING TIME (sec) |
|---|---|---|
| MPT | 3 | 0 |
| TRAY1 | 1 | 0 |
| TRAY2 | 0 | 2 |
| TRAY3 | 0 | 3 |
| TRAY4 | 0 | 4 |
| TRAY5 | 0 | 5 |

FIG.17A

| TRAY NO. | MEDIUM FEEDING WAITING TIME (sec) | IMAGE FORMATION WAITING TIME (sec) |
|---|---|---|
| MPT | 3.2 | 0 |
| TRAY1 | 1.2 | 0 |
| TRAY2 | 0 | 1.8 |
| TRAY3 | 0 | 2.8 |
| TRAY4 | 0 | 3.8 |
| TRAY5 | 0 | 4.8 |

FIG.17B

| TRAY NO. | MEDIUM FEEDING WAITING TIME (sec) | IMAGE FORMATION WAITING TIME (sec) |
|---|---|---|
| MPT | 4 | 0 |
| TRAY1 | 2 | 0 |
| TRAY2 | 0.4 | 0 |
| TRAY3 | 0 | 2 |
| TRAY4 | 0 | 3 |
| TRAY5 | 0 | 4 |

FIG.28A

| TRAY NO. | MEDIUM FEEDING TIME (sec) |
|---|---|
| MPT | 0.5 |
| TRAY1 | 1 |
| TRAY2 | 2 |
| TRAY3 | 3 |
| TRAY4 | 4 |
| TRAY5 | 5 |

FIG.28B

| MANUSCRIPT SIZE | SCANNING TIME (sec) |
|---|---|
| A3 | 3 |
| B4 | 2.5 |
| A4 | 1 |
| A4R | 0.5 |
| B5 | 0.5 |

IMAGE PROCESSING APPARATUS

BACKGROUND OF THE INVENTION

The present invention relates to an image processing apparatus configured to separate and feed media (such as printing sheets) stacked on a tray, and to form images on the media.

Generally, an image processing apparatus includes a medium feeding unit that feeds a medium from a tray, and an image forming that forms an image on the medium. The medium feeding unit starts feeding the medium from the tray at the same time the image forming unit performs an image formation preparation, and then the image forming unit forms an image on the medium fed by the medium feeding unit (see, for example, Patent Document No. 1).

Patent Document No. 1: Japanese Laid-open Patent Publication H10-39694 (paragraph 0008, FIG. 1)

In this regard, there is a demand for enhancement in lifetime of the image forming unit.

SUMMARY OF THE INVENTION

The present invention is intended to provide an image processing apparatus capable of lengthening a lifetime of an image forming unit.

The present invention provides an image processing apparatus including a plurality of medium storage portions, a medium feeding unit that feeds a medium from any one of the medium storage portions, an image forming unit that performs image formation to thereby form an image on the medium fed by the medium feeding unit, a storage unit that stores an image formation waiting time after the medium feeding unit starts feeding the medium from the medium storage portion and before the image forming unit starts the image formation, and a control unit that causes the image forming unit to wait for a time interval based on the image formation waiting time, after the medium feeding unit starts feeding the medium.

With such a configuration, an unnecessary operation of the image forming unit is reduced, and therefore the lifetime of the image forming unit is lengthened.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the attached drawings:

FIGS. 17A and 17B are schematic views showing examples of a waiting time reference table according to the first embodiment;

FIGS. 28A and 28B are schematic views showing tables contained in a waiting time reference table according to the second embodiment;

DETAILED DESCRIPTION OF THE PREFERRED EMBODIMENT

Hereinafter, embodiments of the present invention will be described with reference to drawings. The present invention is not limited to the embodiment described below, and modifications and improvements may be made to the invention without departing from the spirit and scope of the invention.

First Embodiment

Figure 1:
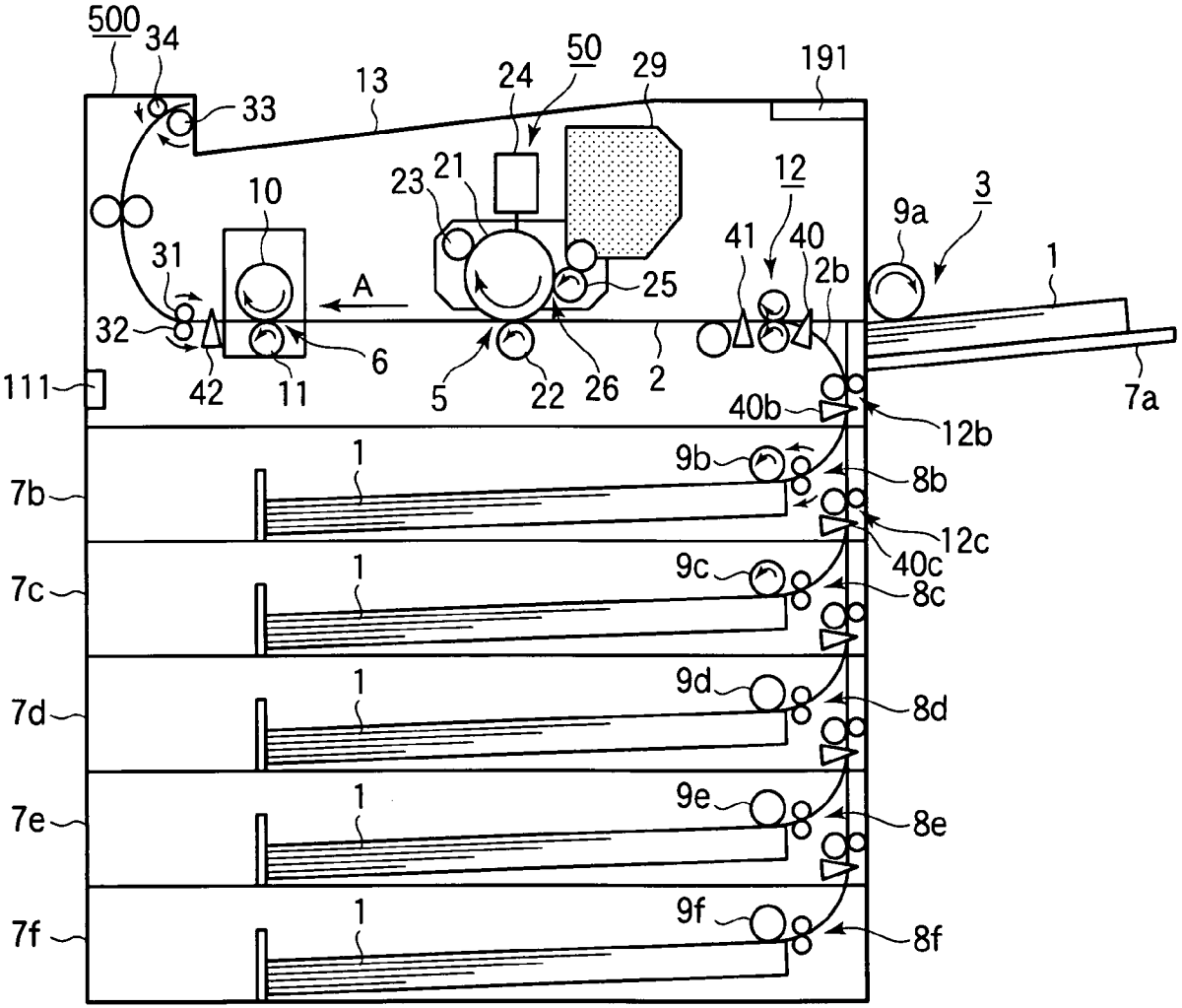
FIG. 1 is a side view schematically showing a configuration of an image processing apparatus (of a monochrome direct transfer type) according to the first embodiment.

FIG. 1 is a side view schematically showing a printer 500 of a monochrome direct transfer type as an image processing apparatus according to the first embodiment of the present invention.

In FIG. 1, the printer 500 has a medium feeding path 2 along which a printing medium 1 (for example, a sheet) is fed as shown by an arrow A. The printer 500 includes a medium pickup unit 3, a toner transferring portion 5 and a fixing unit 6 (i.e., a thermal fixing unit) which are provided along the medium feeding path 2. A multi-purpose tray (MPT) 7*a* is provided on an end of the medium feeding path 2, and an ejection tray 13 is provided on the other end of the medium feeding path 2. The MPT 7*a* is configured to store the printing medium 1 therein. The ejection tray 13 is configured to receive the printing medium 1 (on which an image is printed) thereon.

The medium pickup unit 3 (a medium feeding unit) includes a pickup roller 9*a* that rotates in a direction shown by an arrow to feed the individual printing media 1 one by one from the MPT 7*a* into the medium feeding path 2.

Registration rollers 12 are provided on the medium feeding path 2 and rotate in directions indicated by arrows. The printing medium 1 is picked up by the pickup roller 9*a*, is fed into the medium feeding path 2, and is carried by the registration rollers 12 to reach the toner transferring portion 5. A feeding sensor 41 is provided on the medium feeding path 2, and detects the passage of a leading end of the printing medium 1. Based on the detection of the printing medium 1 by the feeding sensor 41, a timing of image formation on the printing medium 1 is controlled.

The printer 500 includes an image forming unit 50 including a photosensitive drum 21 (as a latent image bearing body), a transferring roller 22 (as a transferring member), a charging roller 23 (as a charging member), an LED head 24 (as an exposure unit), a developing roller 25 (as a developing member) and a toner cartridge 29. The above described toner transferring portion 5 is a contact portion between the photosensitive drum 21 and the transfer roller 22 respectively rotating in directions indicated by arrows. The photosensitive drum 21 is rotated by a not shown drum motor.

The charging roller 23 applies a negative electric charge to an entire surface of the photosensitive drum 21 to thereby uniformly charge the surface of the photosensitive drum 21.

The LED (Light Emitting Diode) head 24 emits light according to a printing pattern, and exposes the surface of the photosensitive drum 21. An electric potential of an exposed part of the photosensitive drum 21 is reduced to almost zero, and a latent image is formed on the surface of the photosensitive drum 21.

A toner (i.e., a developer) is stored in the toner cartridge. 29, and is supplied to the developing roller 25 via a plurality of rollers (not shown).

The toner supplied to the developing roller 25 is negatively charged. At a contact portion 26 between the photosensitive drum 21 and the developing roller 25, the negatively charged toner does not adhere to a non-exposed part of the photosensitive drum 21 (which is negatively charged by the charging roller 23), but adheres to the exposed part of the photosensitive drum 21 whose electric potential is reduced to zero by the exposure. That is, the latent image is developed (visualized) with the toner, so that a toner image is formed on the photosensitive drum 21.

As the photosensitive drum 21 rotates, the toner image reaches the toner transferring portion 5, and the toner image is transferred to the printing medium 1 which is fed along the medium feeding path 2. To be more specific, the transfer roller 22 applies a positive high electric potential to the printing medium 1 from the backside of the printing medium 1, so that the negatively charged toner moves from the photosensitive drum 21 to the printing medium 1.

The printing medium 1 (to which the toner image is transferred) is fed along the medium feeing path 2 to reach the fixing unit 6. The fixing unit 6 includes a fixing roller 10 and a pressure, roller 11 respectively rotating in directions indicated by arrows. The fixing roller 10 has a heat source such as a halogen lamp therein, and is configured to fix the toner image (transferred to the printing medium 1) to the printing medium 1 at a contact portion with the pressure roller 11.

The printing medium 1 (to which the toner image is fixed) is further carried in the direction shown by the arrow A by means of carrying rollers 31 and 32 respectively rotating in directions indicated by arrows, and ejected by ejection rollers 33 and 34 to the ejection tray 13. An ejection sensor 42 is provided on the medium feeding path 2, and detects a passage of a tail end of the printing medium 1. Based on the detection by the ejection sensor 42, it is determined that the printing medium 1 is ejected.

The printer 500 includes an interface connector 111 that receives printing data from a host device such as a personal computer or the like via a LAN (Local Area Network) interface, a USB (Universal Serial Bus) interface or the like.

The printer 500 further includes a display panel 191 such as an LCD (Liquid Crystal Display) or the like for displaying information for a user.

Medium trays (i.e., medium storage portions) 7*b*, 7*c*, 7*d*, 7*d* and 7*f* are detachably mounted to a main body of the printer 500. The medium trays 7*b* through 7*f* respectively store printing media 1 therein. The medium trays 7*b* through 7*f* can store printing media 1 with different shapes and different orientations. Among the medium trays 7*b* through 7*f*, the medium tray storing the printing medium 1 to be used is determined based on a printing data. Further, pickup rollers 9*b*, 9*c*, 9*d*, 9*e* and 9*f* and registration rollers 8*b*, 8*c*, 8*d*, 8*e* and 8*f* are provided respectively on the medium trays 7*b*, 7*c*, 7*d*, 7*e* and 7*f*, for feeding respective printing media 1 from the medium trays 7*b*, 7*c*, 7*d*, 7*e* and 7*f*.

In this regard, the MPT 7*a* and the medium trays 7*b* through 7*f* are collectively referred to as the medium trays 7. The pickup rollers 9*a* through 9*f* are collectively referred to as the pickup rollers 9. The registration rollers 8*b* through 8*f* are collectively referred to as the registration rollers 8.

The printing medium 1 stored in the medium tray 7*b* is picked up by the pickup roller 9*b* (as the medium feeding unit). Then, the printing medium 1 is separately fed into a medium feeding path 2*b* by the registration rollers 8*b*. Registration rollers 12*b* are provided on the medium feeding path 2*b*. The printing medium 1 is aligned and fed by the registration rollers 12*b* to join the above described medium feeding path 2. A sheet sensor 40*b* detects a passage of the leading end of the printing medium 1. Based on the detection by the sheet sensor 40*b*, it is detected that printing medium 1 is fed out of the medium tray 7*b*. The printing media 1 stored in the medium trays 7*c*, 7*d*, 7*e* and 7*f* are fed in a similar manner to the printing medium 1 stored in the medium tray 7*b*.

The pickup rollers 9*a* through 9*f* are driven by a driving mechanism (not shown), and other rollers are driven by a transmission mechanism (not shown).

Figure 2:
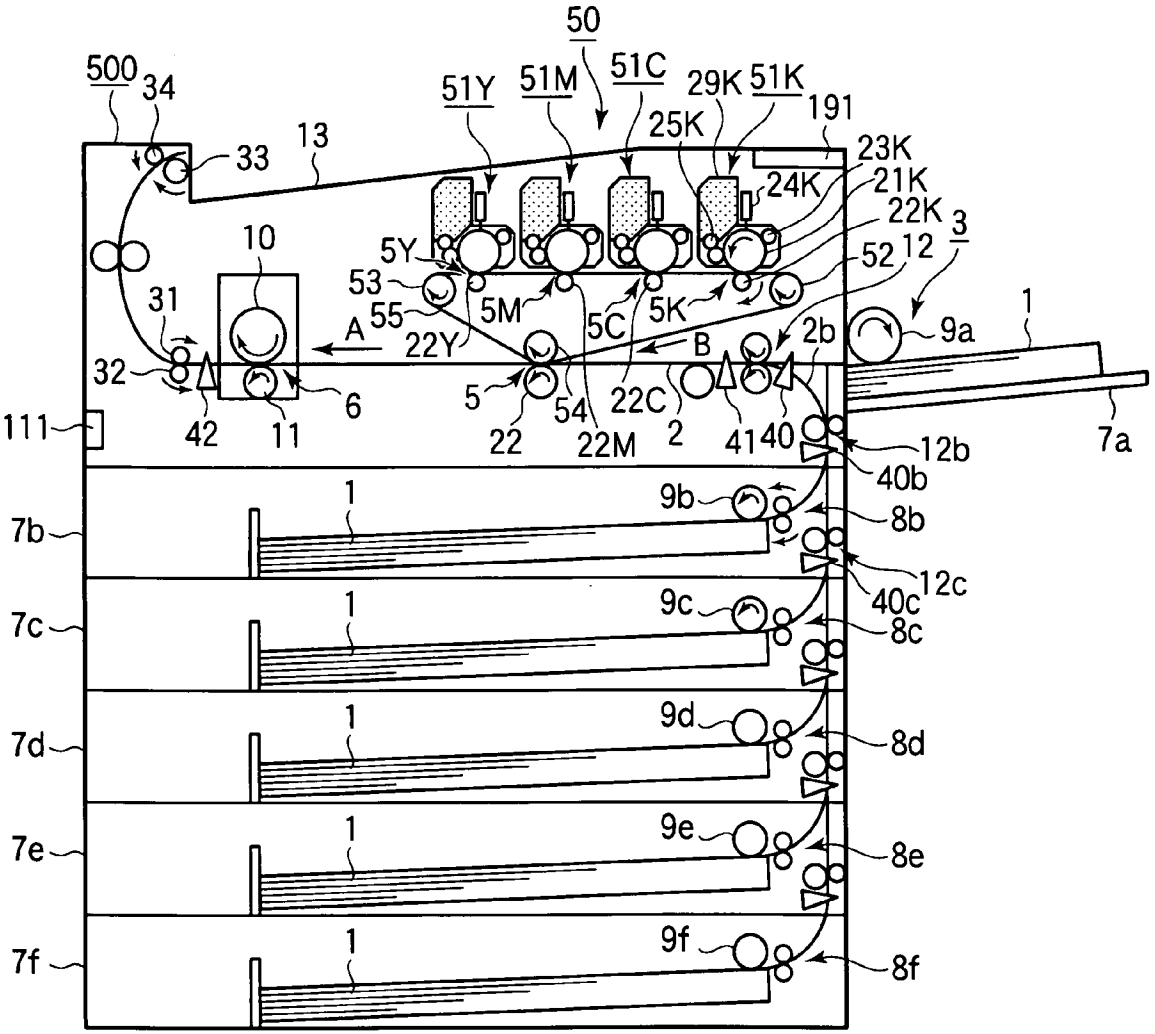
FIG. 2 is a side view schematically showing a configuration of another image processing apparatus (of a color intermediate transfer type) according to the first embodiment.

FIG. 2 is a side view schematically showing a printer 500 of a color intermediate transfer type as an image processing apparatus according to the first embodiment.

Unlike the printer 500 of monochrome direct transfer type (FIG. 1), the printer 500 of color intermediate transfer type (FIG. 2) is configured so that the toner transferring portion 5 is a contact portion between the transfer roller 22 and an intermediate body 55. The intermediate body 55 is movable in a direction indicated by an arrow B. Further, the image forming units 50 is configured as an assembly of four image forming units 51Y, 51M, 51C and 51K that form respective images of yellow (Y), magenta (M), cyan (C) and black (B).

The image forming unit 51K includes a photosensitive drum 21K (as a latent image bearing body), a primary transferring roller 22K (as a transferring member), a charging roller 23K (as a charging member), an LED head 24K (as an exposure unit), a developing roller 25K (as a developing member) and a toner cartridge 29K. A primary toner transferring portion 5K is a contact portion between the photosensitive drum 21K and the primary transferring roller 22K that rotate in directions indicated by arrows.

The charging roller 23K applies a negative electric charge to an entire surface of the photosensitive drum 21K to uniformly charge the surface of the photosensitive drum 21K. The LED head 24K emits light according to a black pattern of the printing pattern, and exposes the surface of the photosensitive drum 21K.

The black toner stored in the toner cartridge 29K is supplied to the developing roller 25K via a plurality of rollers (not shown). The toner supplied to the developing roller 25K adheres to an exposed part of the photosensitive drum 21K at a contact portion between the developing roller 25K and the photosensitive drum 21K.

As the photosensitive drum 21K rotates, the toner image reaches the toner transferring portion 5K, and the toner image is transferred from the photosensitive drum 21K to the intermediate transferring body 55. To be more specific, the transfer roller 22K applies a positive high electric potential to the intermediate transferring medium from the backside of the intermediate transferring medium 55, so that the negatively charged toner moves from the photosensitive drum 21 to the intermediate transferring medium 55.

Other image forming units 51Y, 51M and 51C transfer the respective toner images to the intermediate transferring medium 55 at the primary toner transferring portion 5Y, 5M and 5C in a similar manner to the image forming unit 51K.

The intermediate transferring body 55 is in the form of, for example, an endless belt, and is supported by three driving rollers 52, 53 and 54. The intermediate transferring body 55 moves as shown by an arrow. B by the driving rollers 52, 53 and 54 rotating in directions respectively indicated by arrows. The driving roller 54 is provided so as to contact a transferring roller 22 (as a transferring member) via the intermediate transferring body 55. A contact portion between the intermediate transferring body 55 and the transferring roller 22 constitute a secondary toner transferring portion 5. By the movement of the intermediate transferring body 55 in the direction indicated by the arrow B, the toner image (transferred thereto at the primary toner transferring portions 5Y, 5M, 5C and 5K) reaches the secondary toner transferring portion 5.

At the secondary toner transferring portion 5, the toner image is transferred to the printing medium 1 which is fed along the medium feeding path 2 in the direction indicated by the arrow A. To be more specific, the secondary transferring roller 22 applies a high positive electric potential to the printing medium 1 from the backside of the printing medium 1, so that the negatively charged toner moves from the intermediate transferring body 55 to the printing medium 1.

The printing medium 1 (to which the toner image is fixed) is fed along the medium feeing path 2 to reach the fixing unit 6. Subsequent processes are the same as those of the printer 500 of the monochrome direct transfer type shown in FIG. 1.

The pickup rollers 9*a* through 9*f* are driven by a driving mechanism (not shown), and other rollers are driven by a transmission mechanism (not shown).

Figure 3:
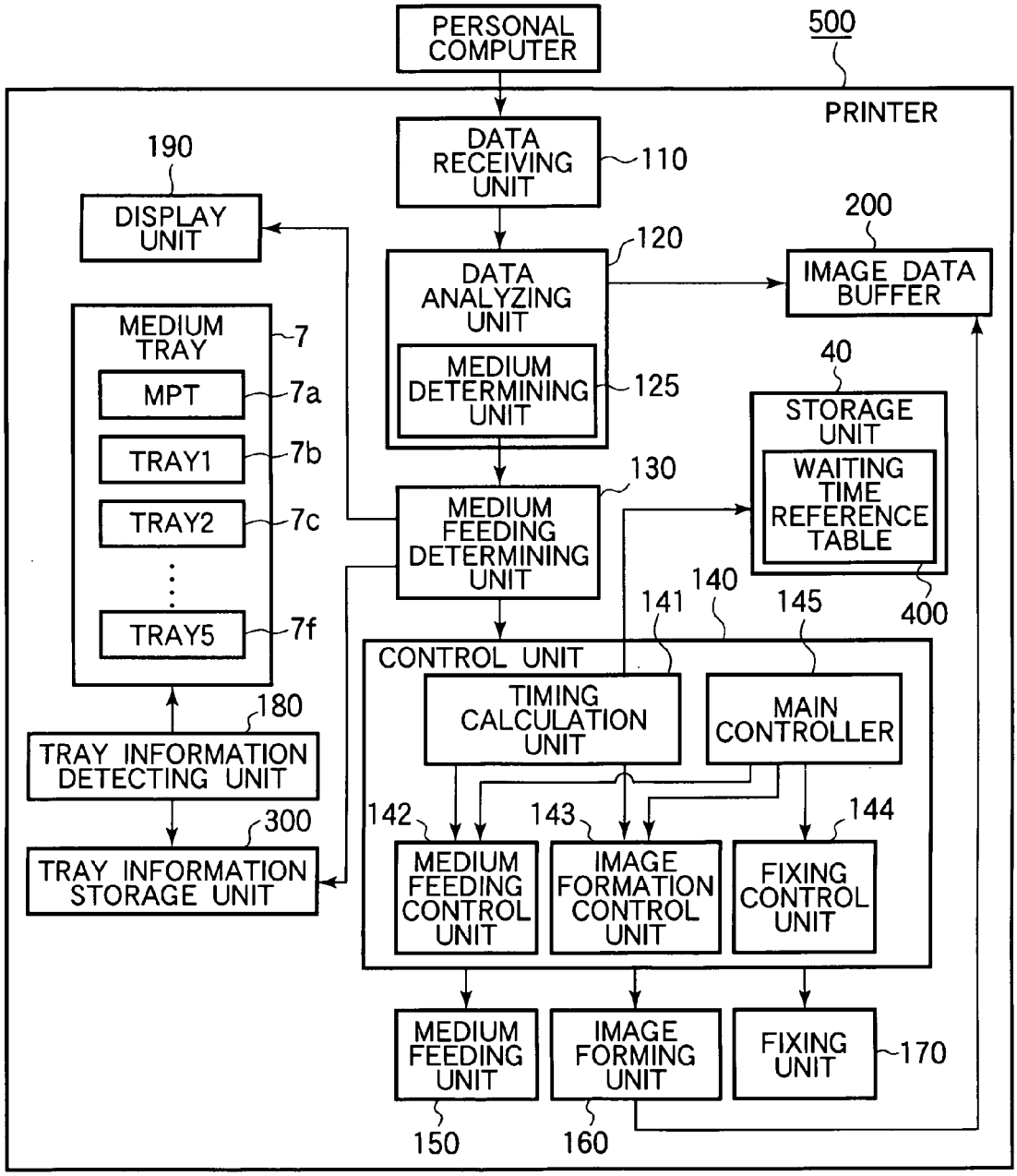
FIG. 3 is a block diagram showing a control system of the image processing apparatus according to the first embodiment of the present invention.

FIG. 3 is a block diagram showing a control system of the printer 500 according to the first embodiment.

In FIG. 3, the printer 500 includes a data receiving unit 110 connected to the host device (i.e., the personal computer) via the interface connector ill (FIG. 1 or 2), a data analyzing unit 120 including a medium determining unit 125, a medium feeding determining unit 130 (i.e., a determining unit), and a control unit 140. The control unit 140 includes a timing calculation unit 141, a medium feeding control unit 142, an image formation control unit 143, a fixing control unit 144, and a main control unit 145 (as an arithmetic unit and a control unit). The printer 500 further includes a medium feeding unit 150, an image forming unit 160, a fixing unit 170, a tray information detecting unit 180, a display unit 190 constituted by the display panel 191 (FIG. 1 or 2), and medium trays 7*a* through 7*f* (FIG. 1 or 2) collectively referred to as the medium tray 7. The printer 500 further includes an image data buffer 200, a tray information storage unit 300, and a storage unit 40 which are accomplished using storage portions of a storage unit such as a nonvolatile memory. The storage unit 40 stores a waiting time reference table 400 as described later.

The feeding unit 150 is constituted by the pickup rollers 9*a* through 9*f* and the registration roller 8*b* trough 8*f* shown in FIG. 1 or 2. Further, the image forming unit 160 is constituted by the image forming unit shown in FIG. 1 or 2. The fixing unit 170 is constituted by the fixing unit 6 shown in FIG. 1 or 2.

The data receiving unit 110 receives printing data sent from the personal computer, and transfers the received printing data to the data analyzing unit 120.

The data analyzing unit 120 obtains a size of the printing medium 1 to be used, based on the received printing data, and notifies the medium feeding determining unit 130 of the size of the printing medium 1. Further, the data analyzing unit 120 analyzes the printing data, creates a printing image data, and stores the printing image data in the image data buffer 200.

The medium feeding determining unit 130 identifies (selects) which of the medium trays 7 stores the printing medium 1 having the received size. If no printing medium is stored in the selected medium tray 7, the medium feeding determining unit 130 causes the display unit 190 to display a message prompting a user to replenish the printing medium 1 to the selected medium tray 7. If the printing medium 1 is stored in the selected medium tray 7, the medium feeding determining unit 130 notifies the control unit 140 of a tray number of the selected medium tray 7.

In the control unit 140, the timing calculation unit 141 refers to the waiting time reference table 400 of the storage unit 40, based on the tray number notified by the medium feeding determining unit 130. From the waiting time reference table 400, the timing calculation unit 141 obtains a medium feeding waiting time and an image formation waiting time with respect to the selected medium tray 7. Further, the timing calculation unit 141 notifies the medium feeding control unit 142 and the image formation control unit 143 respectively of the medium feeding waiting time and the image formation waiting time. The medium feeding waiting time is a time interval after the main controller 145 sends a printing start command and before the medium feeding unit 150 starts feeding the printing medium 1 (see, FIG. 15). The image formation waiting time is a time interval after the main controller 145 sends the printing start command and before the image forming unit 160 starts image formation (see, FIG. 16).

The control unit 140 notifies the medium feeding unit 150 of the tray number of the selected medium tray 7.

The control unit 140 causes the main controller 145 to monitor the fixing control unit 144. The fixing control unit 144 controls the fixing roller 10 (FIG. 1 or 2) of the fixing unit 170, and maintains the temperature of the fixing roller 10 within a temperature range suitable for fixing. When the main controller 145 determines that the fixing unit 170 can perform a fixing operation (under control of the fixing control unit 144), the main controller 145 sends the printing start command to the medium feeding control unit 142 and the image formation control unit 143 to start printing operation.

On receiving the printing start command from the main controller 145, the medium feeding control unit 142 and the image formation control unit 143 respectively start operating the medium feeding unit 150 and the image forming unit 160 at timings determined based on the waiting times notified by the timing calculation unit 141.

The medium feeding unit 150 picks up the printing medium 1 from the selected medium tray 7 at the instructed timing, and feeds the printing medium 1.

The image forming unit 160 reads a printing image data from the image data buffer 200, and forms an image on the photosensitive drum 21 at the instructed timing, and transfers the image to the printing medium 1 (fed by the medium feeding unit 150) at the toner transferring portion 5.

The fixing unit 170 thermally fixes the image (transferred at the image forming unit 160) to the printing medium 1.

The tray information detecting unit 180 checks the medium trays 7 (7*a* through 7*f*) at predetermined timings. If an amount of the printing medium 1 or a setting of size or orientation of the printing medium 1 in any of the medium trays 7 changes, the tray information detecting unit 180 accesses the tray information storage unit 300, and rewrites the stored data. Therefore, the tray information storage unit 300 stores the size, orientation (and if necessary, material) and amount of the printing medium 1 in each of the medium trays 7*a* through 7*f*.

The waiting time reference table 400 contains the medium feeding waiting time (i.e., the waiting time before the start of the medium feeding) and the image formation waiting time (i.e., the waiting time before the start of the image formation) with respect to each of the respective medium trays 7*a* through 7*f*.

The control unit 140 controls an entire operation of the printer 500 based on a control program (software) stored in a storage unit such as a memory. The control unit 140 has a timer or other time-counting means.

A function of the above configured printer 500 will be described.

Figure 4:
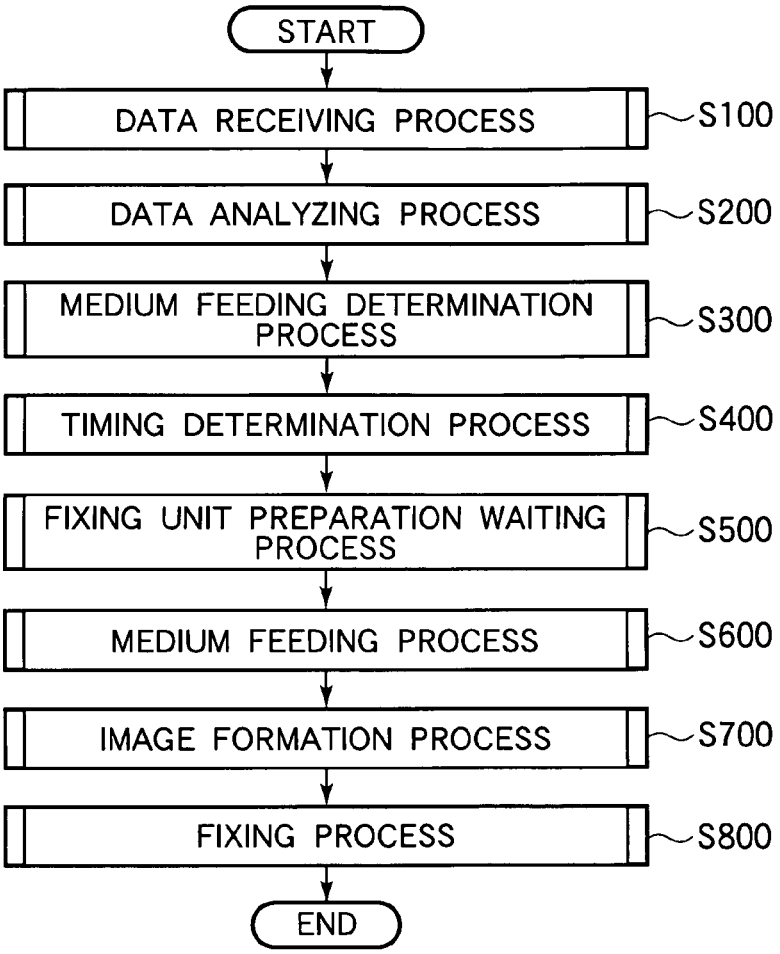
FIG. 4 is a flow chart showing a printing operation according to the first embodiment.

FIG. 4 is a flow chart showing a printing operation of the printer 500. The printing operation of the printer 500 will be described with reference to FIG. 4 as well as FIG. 3.

In a step S100, when the host device (such as the personal computer) sends a printing data to the printer 500, the data receiving unit 110 receives the printing data, and transfers the received printing data to the data analyzing unit 120.

In a step S200, the data analyzing unit 120 analyzes the printing data, detects the size of the printing medium 1 to be used, and notifies the medium feeding determining unit 130 of the size of the printing medium 1. The data analyzing unit 120 further analyzes the printing data, and creates a printing image data.

In a step S300, the medium feeding determining unit 130 performs a medium feeding determination process to determine which of the medium trays 7*a* through 7*f* stores the printing medium 1 of the instructed size, and notify the control unit 140 of the determination result, i.e., the tray number of the medium tray 7.

In a step S400, the control unit 140 performs a timing determination process based on the tray number notified by the medium feeding determining unit 130, and obtains the medium feeding timing and the image formation timing. The control unit 140 notifies the medium feeding control unit 142 and the image formation control unit 143 respectively of the medium feeding timing and the image formation timing. Further, the control unit 140 notifies the medium feeding unit 150 of the tray number of the selected medium tray 7.

In a step S500, the control unit 140 causes the main controller 145 to perform a fixing unit preparation waiting process. The main controller 145 monitors the fixing control unit 144. If the fixing roller 10 is sufficiently heated (i.e., operable), the main controller 145 sends the printing start command to the medium feeding control unit 142 and the image formation control unit 143 so as to start printing.

In a step S600, the medium feeding control unit 142 receives the printing start command, and controls the medium feeding unit 150 to perform the medium feeding process at the instructed timing, i.e., to feed the printing medium 1 from the medium tray 7 instructed by the control unit 140.

In a step S700, the image formation control unit 143 receives the printing start command, and controls the image forming unit 160 to perform the image formation at the instructed timing, i.e., to form an image on the photosensitive drum 21 (FIG. 1 or 2) and transfers the image to the printing medium 1 fed to the toner transferring portion 5.

In a step S800, the fixing control unit 144 controls the fixing unit 170 to perform the fixing process, i.e., to thermally fix the toner image to the printing medium 1. Finally, the printer 500 ejects the printing medium 1 to which the toner image is thermally fixed, and the printing operation is completed.

Figure 5:
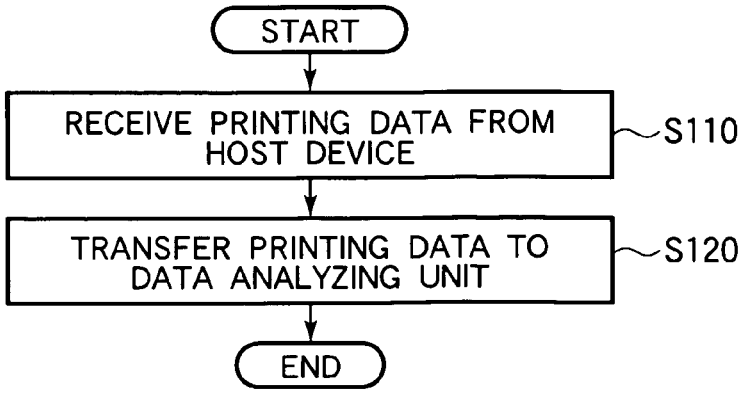
FIG. 5 is a flow chart showing a data receiving process according to the first embodiment.

Next, the data receiving process S100 shown in FIG. 4 will be described with reference to FIG. 5 as well as FIG. 3. FIG. 5 is a flow chart showing the data receiving process of the first embodiment. The data receiving process is performed by the data receiving unit 110.

In a step S110, the data receiving unit 110 receives the printing data from the host device such as the personal computer via a communication line.

In a step S120, the data receiving unit 110 transfers the received printing data to the data analyzing unit 120.

Figure 6:
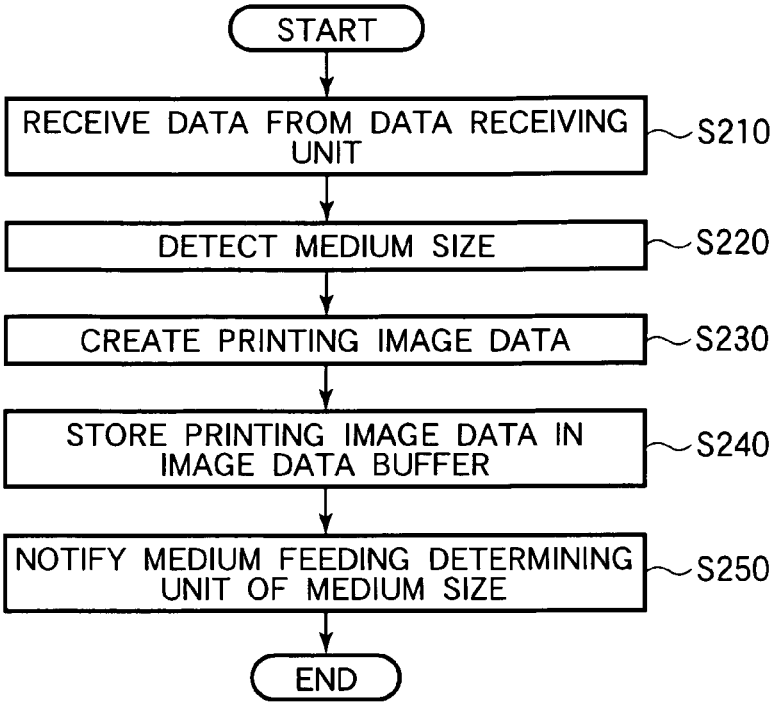
FIG. 6 is a flow chart showing a data analyzing process according to the first embodiment.

Next, the data analyzing process S200 shown in FIG. 4 of the first embodiment will be described with reference to FIG. 6 as well as FIG. 3. FIG. 6 is a flow chart showing the data analyzing process of the first embodiment. The data analyzing process is performed by the data analyzing unit 120.

In a step S210, the data analyzing unit 120 receives the printing data transferred from the data receiving unit 110.

In a step S220, the data analyzing unit 120 activates the medium determining unit 125, and analyzes the printing data to thereby detect the size of the printing medium 1 to be used.

In a step S230, the data analyzing unit 120 further analyzes the printing data, and creates the printing image data therefrom.

In a step S240, the data analyzing unit 120 stores the created printing image data in the image data buffer 200.

In a step S250, the data analyzing unit 120 notifies the medium feeding determining unit 130 of the size of the printing medium 1 (detected at the step S220), and the data analyzing process is completed.

Figure 7:
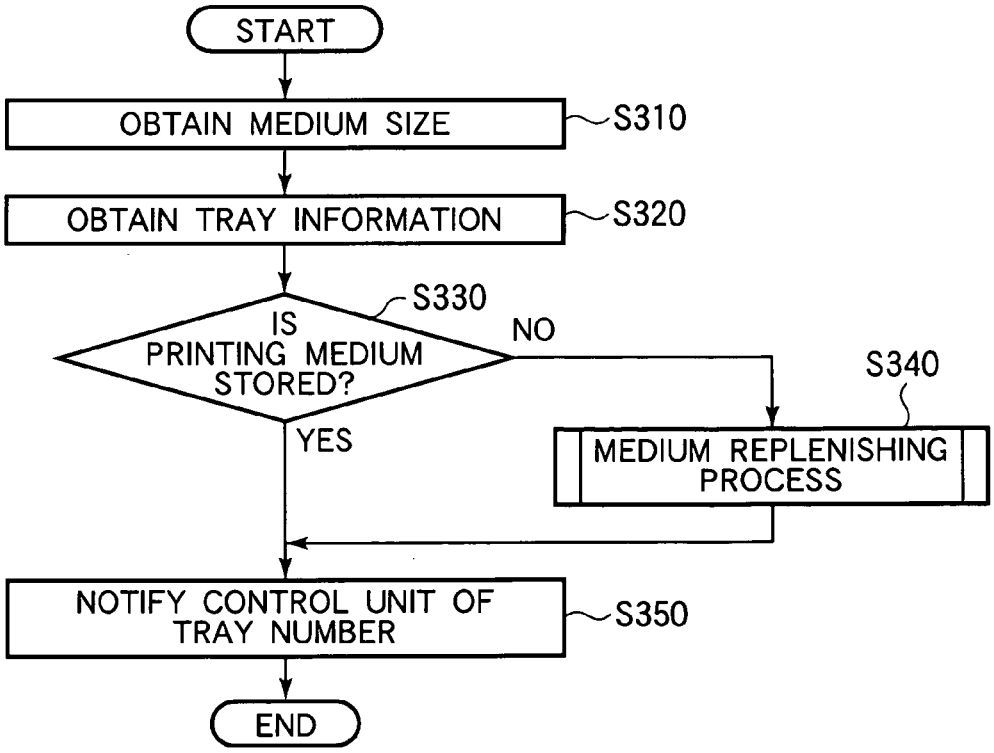
FIG. 7 is a flow chart showing a medium feeding determination process according to the first embodiment.

Next, the medium feeding determination process S300 shown in FIG. 4 will be described with reference to FIG. 7 as well as FIG. 3. FIG. 7 is a flow chart showing the medium feeding determination process of the first embodiment. The medium feeding determination process S300 is performed by the medium feeding determining unit 130.

In a step S310, the medium feeding determining unit 130 obtains the size of the printing medium 1 outputted by the data analyzing unit 120.

In a step S320, the medium feeding determining unit 130 refers to the tray information storage unit 300 based on the size of the printing medium 1, and obtains the tray information. The tray information contains the tray number for identifying the medium tray 7 storing the printing medium 1 of the instructed size, and a rough amount of the printing medium 1 stored therein.

Figures 8, 9:
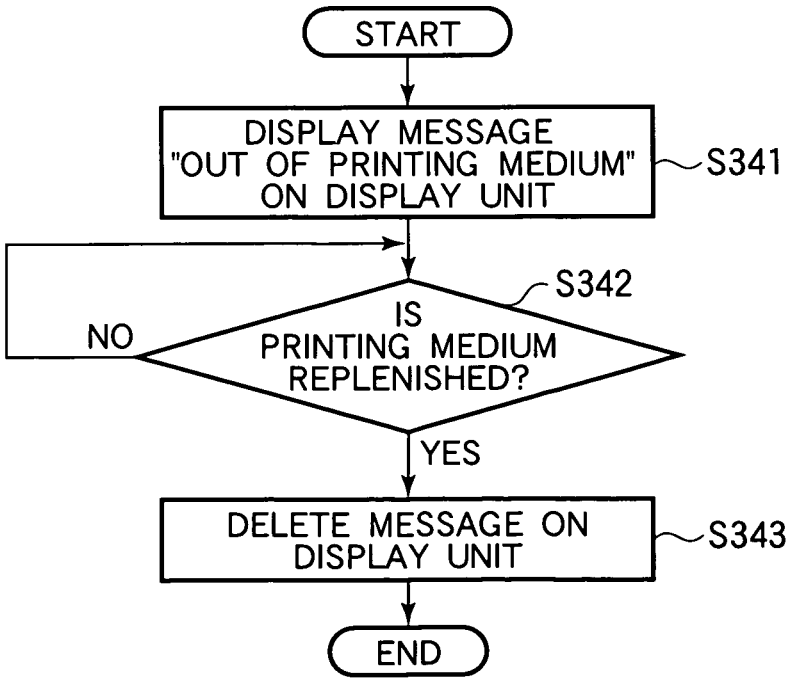
FIG. 8 is a schematic view showing an example of tray information according to the first embodiment.
FIG. 9 is a flow chart showing a medium replenishing process according to the first embodiment.

FIG. 8 shows an example of the tray information stored in the tray information storage unit 300. As shown in FIG. 8, the tray information contains the size, orientation and storage amount (%) of the printing medium 1 with respect to each tray number. For example, if the medium feeding determining unit 130 is notified by the data analyzing unit 120 of the size and orientation of the printing medium 1 as "A4" and "horizontal", the medium feeding determining unit 130 searches the tray information, and selects "tray 2" identifying the medium tray 7*c* storing the target printing medium 1 (i.e., the printing medium 1 of the instructed size and orientation).

In a step S330, the medium feeding determining unit 130 determines, based on the obtained tray information, whether the target printing medium 1 is stored in the selected medium tray 7. If the medium feeding determining unit 130 determines that the target printing medium 1 is stored in the selected medium tray 7, the medium feeding unit 130 proceeds to a step S350. If the medium feeding determining unit 130 determines that the selected medium tray 7 is out of printing medium 1, the medium feeding unit 130 proceeds to a step S340.

In the step S340, the medium feeding determining unit 130 performs the medium replenishing process.

In the step S350, the medium feeding determining unit 130 notifies the control unit 140 of the tray number of the selected medium tray 7, and the medium feeding determination process is completed. In the case of the tray information shown in FIG. 8, the printing medium 1 of the size of "A4" and the orientation of "horizontal" is stored in the medium tray 7*c* whose tray number is "tray 2", and the amount of the printing medium 1 in the medium tray 7*c* is 20%. In this case, the medium feeding determining unit 130 notifies the control unit 140 of the information of the tray number "tray 2".

Next, the medium replenishing process S340 shown in FIG. 7 will be described with reference to FIG. 9 as well as FIG. 3. FIG. 9 is a flow chart showing the medium replenishing process of the first embodiment. The medium replenishing process is performed by the medium feeding determining unit 130.

In a step S341, when the target printing medium 1 is not stored in the selected medium tray 7, the medium feeding determining unit 130 causes the display unit 190 to display a message informing a user that the selected medium tray 7 is out of printing medium 1.

In a step S342, the medium feeding determining unit 130 waits for the medium tray 7 to be replenished with the printing medium 1 by the user.

In a step S343, when the medium feeding determining unit 130 detects (using a sensor or the like) that the medium tray 7 is replenished with the printing medium 1, the medium feeding determining unit 130 causes the display unit 190 to delete the message, and the medium replenishing process is completed. Then, the medium feeding determining unit 130 proceeds to the step S350 of FIG. 7.

Figures 10, 11:
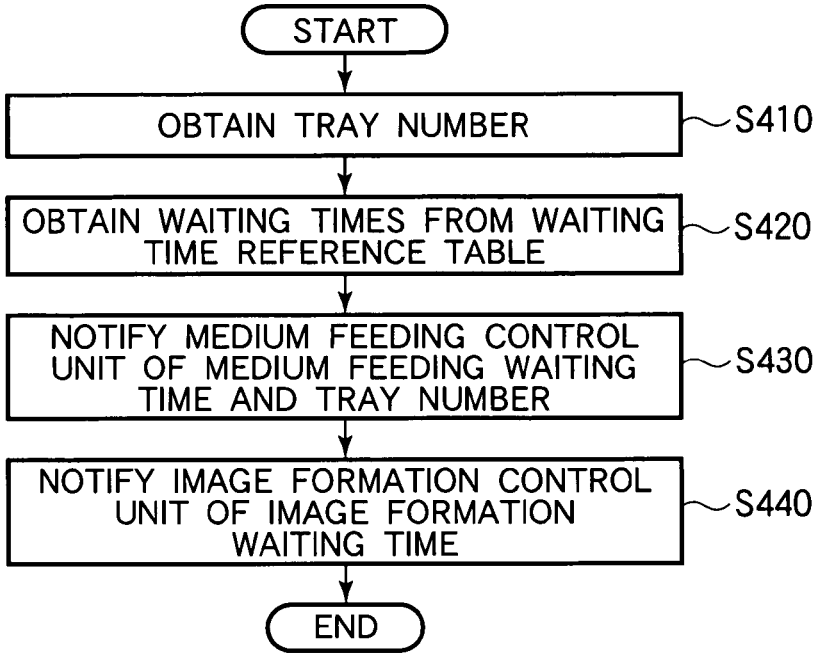
FIG. 10 is a flow chart showing a timing determination process according to the first embodiment.
FIG. 11 is a schematic view showing a waiting time reference table according to the first embodiment.

Next, the timing determination process S400 shown in FIG. 4 will be described with reference to FIG. 10 as well as FIG. 3. FIG. 10 is a flow chart showing the timing determination process of the first embodiment. The timing determination process is performed by the control unit 140 activating the timing calculation unit 141.

In a step S410, the control unit 140 obtains the tray number from the medium feeding determining unit 130.

In a step S420, the control unit 140 activates the timing calculation unit 141 using the tray number as argument. The timing calculation unit 141 refers to the waiting time reference table 400 using the tray number, and obtains the medium feeding waiting time and the image formation waiting time.

FIG. 11 is a schematic view showing an example of the waiting time reference table 400 of the first embodiment.

As shown in FIG. 11, the waiting time reference table 400 stores the medium feeding waiting time and the image formation waiting time with respect to each medium tray 7. The medium feeding waiting time provides a timing at which the medium feeding is started, and the image formation waiting time provides a timing at which the image formation is started. The waiting times are provided for matching the timings of the medium feeding and the image formation with each other.

As can be understood from FIG. 11, the image formation waiting time becomes longer as a distance from the toner transferring portion 5 to the medium tray 7 increases.

For example, when the printing is performed on the printing medium 1 stored in the MPT 7*a* which is the closest to the toner transferring portion 5, a time (t2) required for feeding the printing medium 1 from the MPT 7*a* to the toner transferring portion 5 is shorter than a time (t1: first time) required for image formation preparation (i.e., required for the photosensitive drum 21 to be charged, exposed, developed, and rotated to bring the toner image to the toner transferring portion 5). In this case, the medium feeding is started after waiting for a time interval (i.e., the medium feeding waiting time) after the image formation is started. In the case of MPT 7*a*, the image formation waiting time is 3 seconds, as shown in FIG. 11.

In contrast, when the printing is performed on the printing medium 1 stored in the medium tray 7*f* (i.e., tray 5) which is the farthest from the toner transferring portion 5, the time (t2: a second time) required for feeding the printing medium 1 from the medium tray 7*f* to the toner transferring portion 5 is longer than a time (t1) required for the image formation preparation. In this case, if the medium feeding and the image formation are started at the same time, the photosensitive drum 21 needs to rotate unnecessarily until the printing medium 1 reaches the toner transferring portion 5.

Therefore, in this embodiment, the image formation is started after waiting for a time interval (i.e., the image formation waiting time) after the medium feeding is started. In other words, the image formation is started when the printing medium 1 is partially fed along the medium feeing path. With such an operation, the unnecessary rotation of the photosensitive drum 21 is reduced. In the case of the medium tray 7*f* (i.e., tray 5), the image formation waiting time is set to 5 seconds, as shown in FIG. 11. Further, in the case of the medium tray 7*c* (i.e., tray 2), the image formation waiting time is 2 seconds.

Here, the time t1 (seconds) required for image formation preparation is defined as a time required for the photosensitive drum 21 to be charged, exposed, developed, and rotated to bring the toner image to the toner transferring portion 5, as described above. This time t1 is referred to as an "image formation preparation time t1". Further, the time t2 (seconds) required for medium feeding is defined as a time after the medium feeding unit 150 starts picking up and feeding the printing medium 1 from the selected medium tray 7 to the toner transferring portion 5. This time t2 is referred to as a "medium feeding time t2".

If the image formation preparation time t1 is longer than the medium feeding time t2 (i.e., t1>t2), the medium feeding waiting time of (t1−t2) seconds is provided. In other words, the medium feeding unit 150 waits for (t1−t2) seconds after the image formation is started.

In contrast, if the image formation preparation time t1 is shorter than the medium feeding time t2 (i.e., t1<t2), the image formation waiting time of (t2−t1) seconds is provided. In other words, the image forming unit 160 waits for (t2−t1) seconds after the medium feeding is started.

The waiting times stored in the waiting time reference table shown in FIG. 11 have been obtained by fixing the image formation preparation time t1 to a constant value, and varying the medium feeding times t2 according to positions of the medium trays 7*a* through 7*f*.

In this regard, the image formation preparation time t1 is defined as a time after the drum motor of the image forming unit 160 is driven to rotate the photosensitive drum 21 (so that the photosensitive drum 21 is charged, exposed and developed) and before the developed image reaches the toner transferring portion 5. In this embodiment, the image formation preparation time t1 is a unique value to each printer 500.

Further, in this embodiment, the feeding speeds for feeding the printing medium 1 from the respective medium trays 7 to the toner transferring portion 5 are the same.

In a step S430, the timing calculation unit 141 (that has obtained the waiting times) notifies the medium feeding control unit 142 of the medium feeding waiting time and the tray number (i.e., the number of the selected medium tray 7).

In a step S440, the timing calculation unit 141 notifies the image formation control unit 143 of the image formation waiting time, and the timing determination process is completed.

Figure 12:
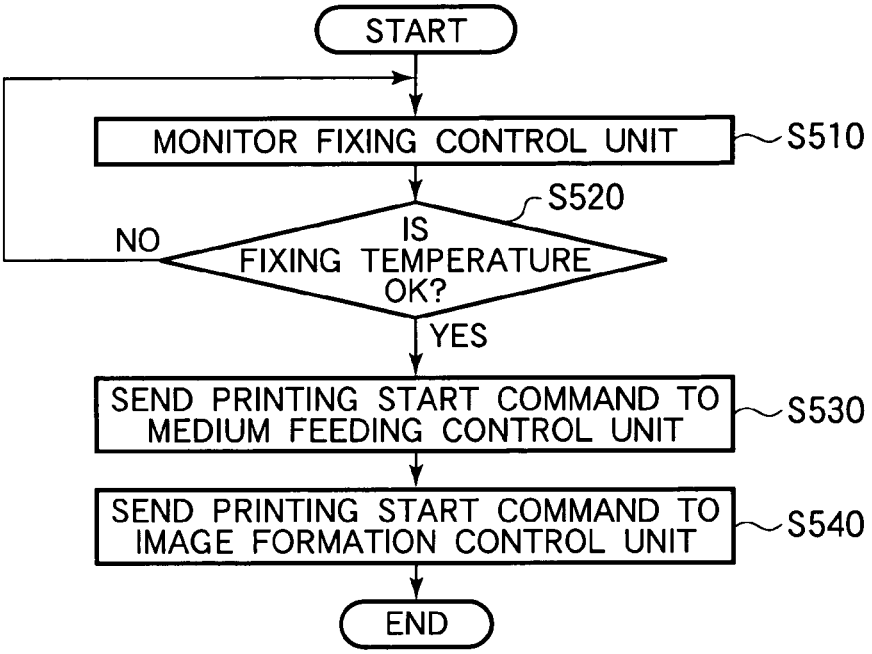
FIG. 12 is a flow chart showing a fixing unit preparation waiting process according to the first embodiment.

Next, the fixing unit preparation waiting process S500 shown in FIG. 4 of the first embodiment will be described with reference to FIG. 12 as well as FIG. 3. FIG. 12 is a flow chart showing the fixing unit preparation waiting process of the first embodiment. The fixing unit preparation waiting process is performed by the main controller 145 of the control unit 140.

Generally, when the fixing unit 6 does not perform fixing process, the heater of the fixing roller 10 (FIG. 1 or 2) is turned off, and the temperature of the fixing roller 10 is low. Therefore, when the printer 500 receives the printing data and starts printing operation, other units (than the fixing unit 6) must wait until the temperature of the fixing roller 10 rises to a temperature range suitable for fixing.

For this reason, in a step S510, the main controller 145 starts monitoring the fixing control unit 144.

The fixing unit control unit 144 is configured to control the fixing roller 10 of the fixing unit 170 to maintain the surface temperature of the fixing roller 10 within the suitable temperature range for fixing.

In a step S520, the main controller 145 checks whether the temperature of the fixing roller 10 is within the suitable temperature range, via the fixing control unit 144.

In a step S530, when the temperature of the fixing roller 10 reaches the suitable temperature range, the main controller 145 sends the printing start command to the medium feeding control unit 142.

Further, in a step S540, the main controller 145 sends the printing start command to the image formation control unit 143.

Figure 13:
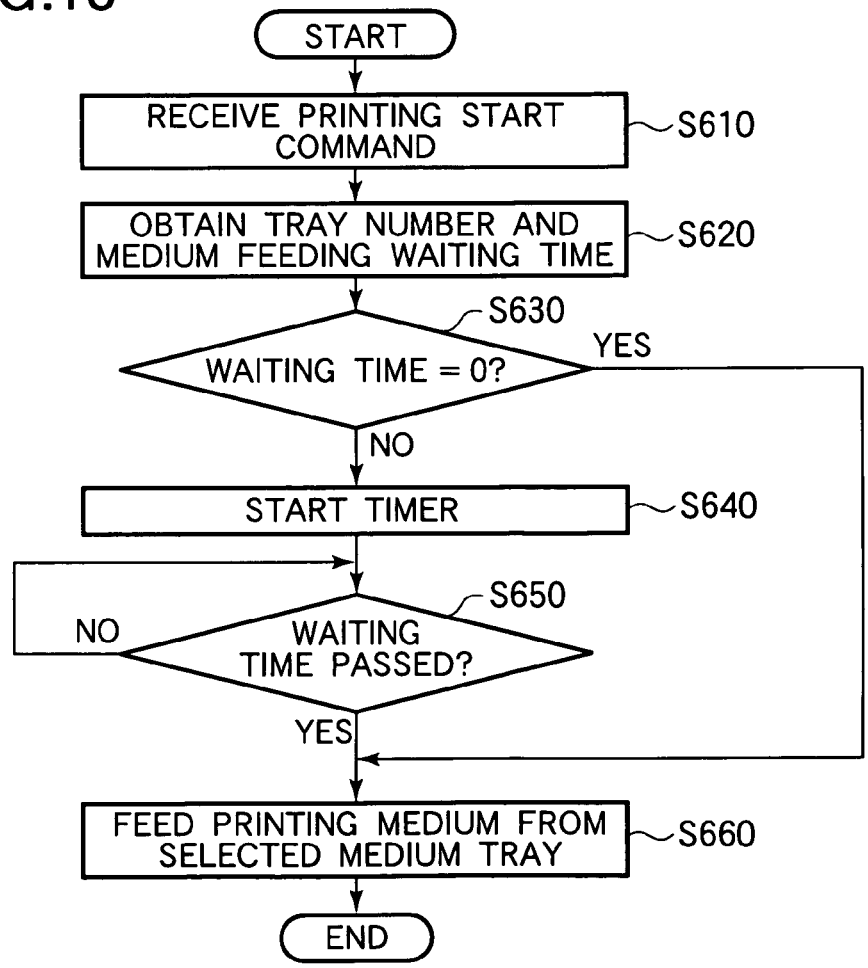
FIG. 13 is a flow chart showing a medium feeding process according to the first embodiment.

Next, the medium feeding process S600 shown in FIG. 4 of the first embodiment will be described with reference to FIG. 13 as well as FIG. 3. FIG. 13 is a flow chart showing the medium feeding process of the first embodiment. The medium feeding process is performed by the medium feeding unit 150 under control of the medium feeding control unit 142.

In a step S610, the medium feeding control unit 142 receives the printing start command from the main controller 145.

In a step S620, the medium feeding control unit 142 obtains the tray number (identifying the selected medium tray 7) and the medium feeding waiting time, from the timing calculation unit 141.

In a step S630, if the medium feeding waiting time (obtained at the step S620) is "0", the medium feeding control unit 142 proceeds to a step S660 and starts medium feeding. If the medium feeding waiting time is not "0", the medium feeding control unit 142 proceeds to a step S640.

In the step S640 (i.e., in the case where the image medium feeding waiting time is not 0), the medium feeding control unit 142 starts a timer.

In a step S650, the medium feeding control unit 142 waits for the medium feeding waiting time to pass, using the timer.

In a step S660 (i.e., as the medium feeding waiting time has passed), the medium feeding control unit 142 controls the medium feeding unit 150 to start the medium feeding, i.e., to pickup and feed the print medium 1 from the selected medium tray 7.

Figure 14:
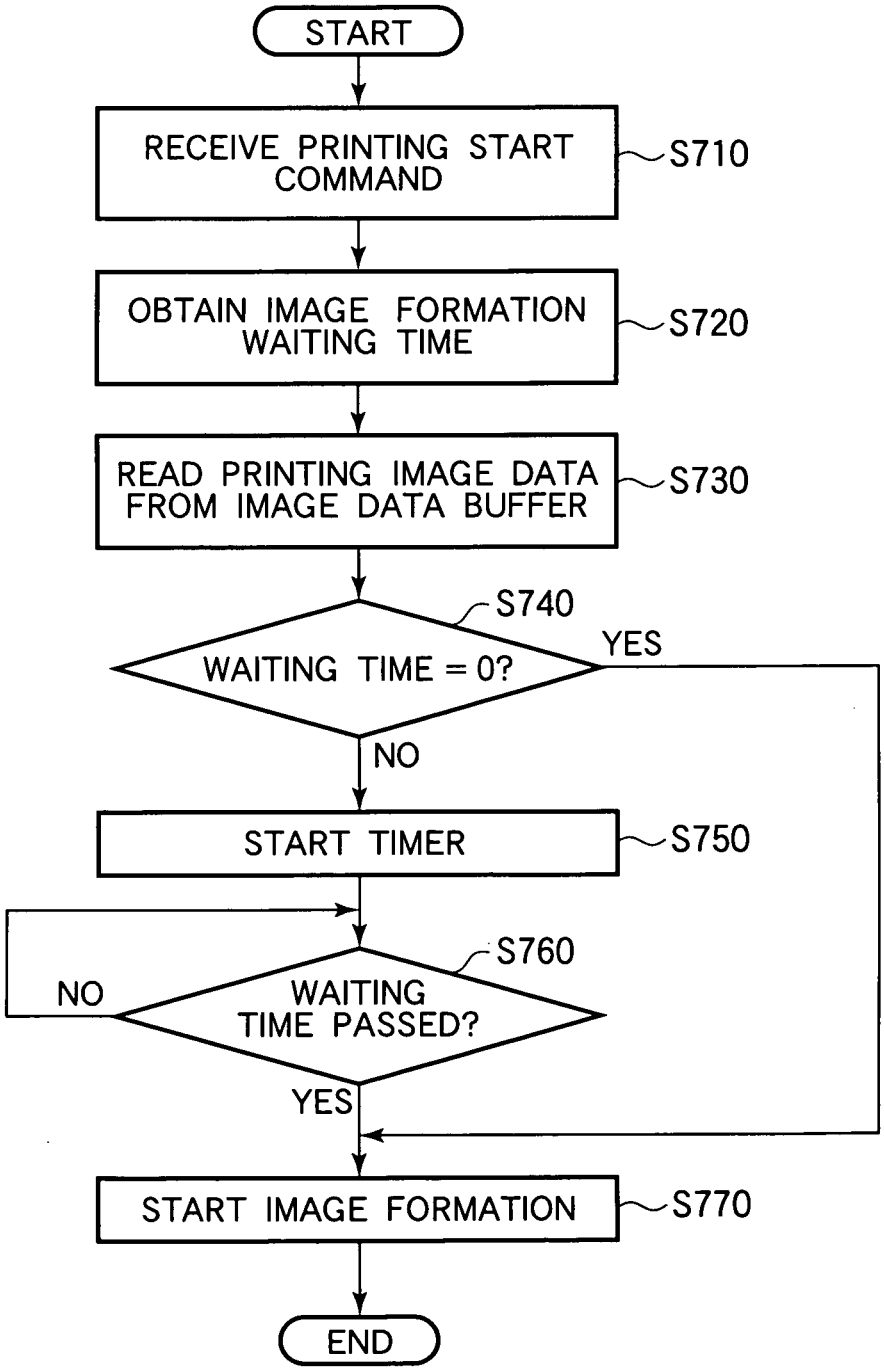
FIG. 14 is a flow chart showing an image formation process according to the first embodiment.

Next, the image formation process S700 shown in FIG. 4 will be described with reference to FIG. 14 as well as FIG. 3. FIG. 14 is a flow chart showing the image formation process of the first embodiment. The medium feeding process S700 is performed by the image forming unit 160 under control of the image formation control unit 143.

In a step S710, the image formation control unit 143 receives the printing start command from the main controller 145.

In a step S720, the image formation control unit 143 obtains the image formation waiting time from the timing calculation unit 141.

In a step S730, the image formation control unit 143 accesses the image data buffer 200 (irrespective of the waiting time), and reads the printing image data from the image data buffer 200 to prepare for image formation.

In a step S740, if the image formation waiting time (obtained at the step S720) is "0", the image formation control unit 143 proceeds to a step S770 to start the image formation. If the image formation waiting time is not "0", the image formation control unit 143 proceeds to a step S750.

In the step S750 (i.e., in the case where the image formation waiting time is not 0), the image formation control unit 143 starts a timer.

In a step S760, the image formation control unit 143 waits for the image formation waiting time to pass, using the timer.

In a step S770 (i.e., as the image formation waiting time has passed), the image formation control unit 143 starts the image formation (including the image formation preparation) based on the printing image data (having been read at the step S730).

With the above described processes, the toner image is formed on the printing medium 1. Then, the printing medium 1 passes the fixing unit 6 (170), is carried by the carrying rollers 31 and 32, and is ejected by the ejection rollers 33 and 34 to the ejection tray 13.

Next, the timings at which the medium feeding and the image formation are started will be described with reference to FIGS. 15 and 16, as well as FIGS. 1 and 2.

Figure 15:
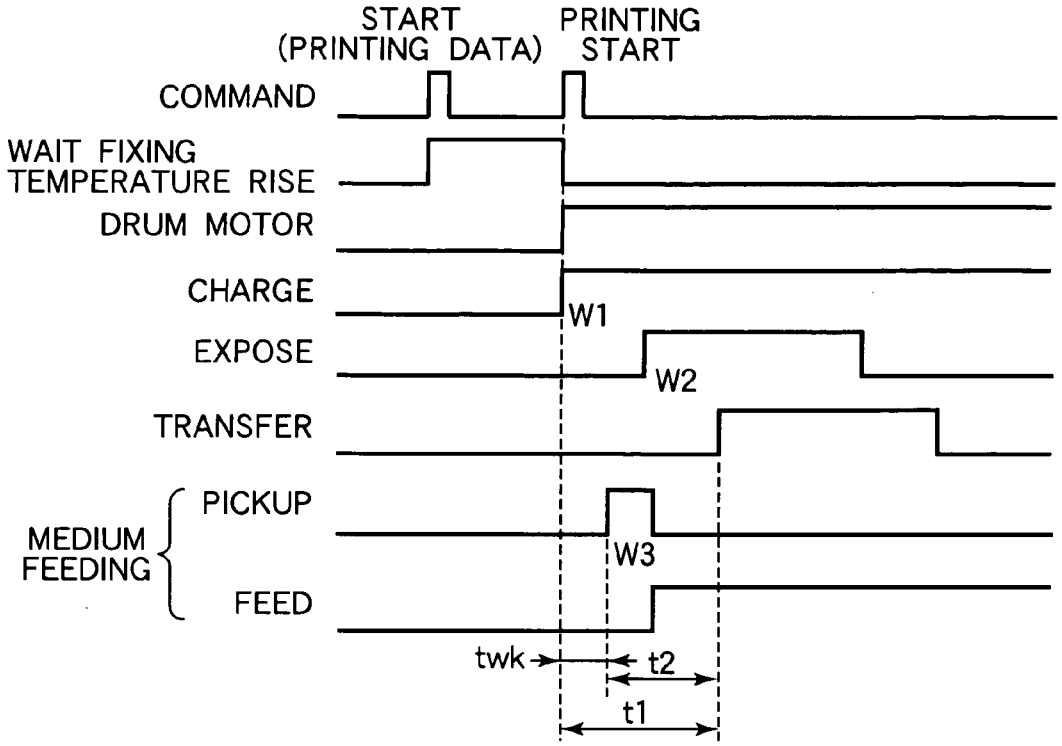
FIG. 15 is a timing chart showing medium feeding and image formation according to the first embodiment.
Figure 16:
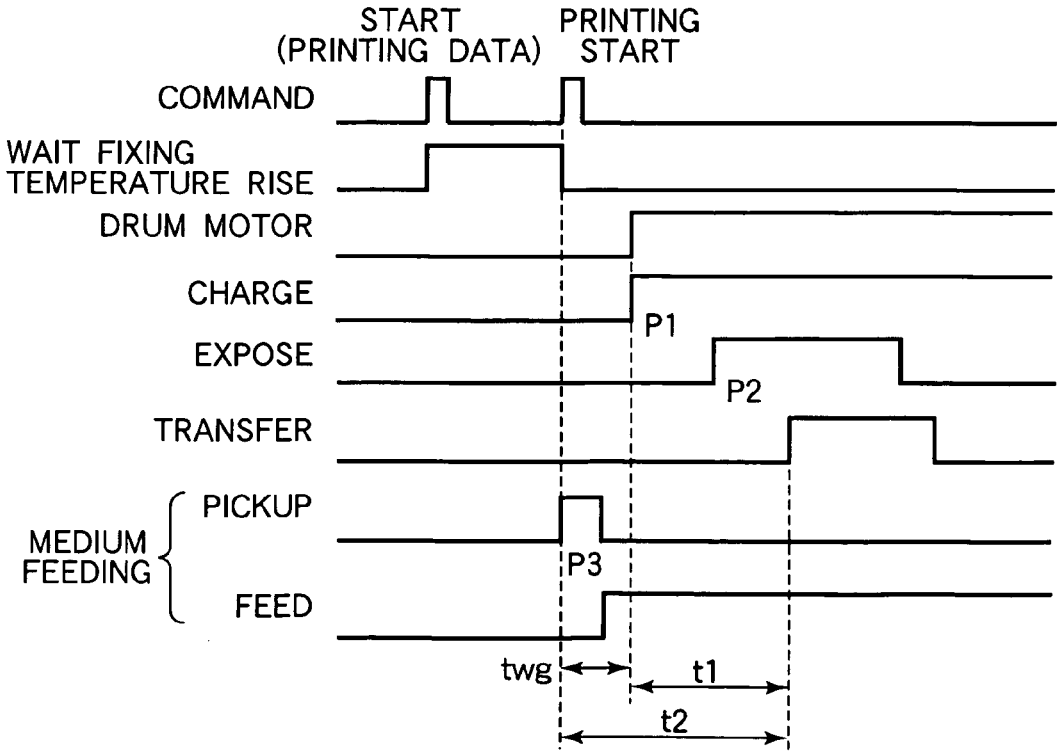
FIG. 16 is another timing chart showing the medium feeding and the image formation according to the first embodiment.

FIGS. 15 and 16 show timing charts showing the medium feeding and the image formation according to the first embodiment. To be more specific, FIGS. 15 and 16 show operation timings of the medium feeding unit 150, the image forming unit 160 and the fixing unit 170.

FIG. 15 shows an example where the image forming unit 160 starts the image formation before the medium feeding unit 150 starts the medium feeding. The example of FIG. 15 corresponds to the case where the medium tray 7 is disposed relatively closer to the toner transferring portion 5. In this case, the medium feeding waiting time (twk) is set for the medium feeding unit 150.

In FIG. 15, when the printer 500 receives a start command (the printing data) from the host device, the fixing control unit 144 controls the fixing unit 170 (6) to raise the temperature of the fixing roller 10 to the suitable temperature range for fixing, and waits for the temperature rise of the fixing roller 10. When the temperature of the fixing roller 10 reaches the suitable temperature range, the main controller 145 sends the printing start command to the medium feeding control unit 142 and the image formation control unit 143.

Upon receiving the printing start command, the image formation control unit 143 drives the not shown drum motor to rotate the photosensitive drum 21, charges the surface of the photosensitive drum 21 (W1), exposes the surface of the photosensitive drum 21 (W2) to form the latent image, and develops the latent image to form the toner image which is transferable. A time after the image formation control unit 143 receives the printing start command and before the image forming unit 160 forms the transferable toner image is expressed as "t1".

A time after the medium feeding unit 150 starts feeding the printing medium 1 (W3) and before the printing medium 1 reaches the toner transferring portion 5 is expressed as "t2". The medium feeding control unit 142 controls the medium feeding unit 150 to start feeding the printing medium 1 after waiting for the medium feeding waiting time twk=(t1−t2) to pass. By providing such waiting time, the printing medium 1 meets the toner image on the photosensitive drum 21. (at the toner transferring portion 5) at a suitable timing.

FIG. 16 shows an example where the medium feeding unit 150 starts the medium feeding before the image forming unit 160 starts the image formation. The example of FIG. 16 corresponds to the case where the medium tray 7 is disposed relatively farther from the toner transferring portion 5 (i.e., a relatively longer time is needed to feed the printing medium 1 to the toner transferring portion 5). In this case, the image formation waiting time (twg) is set for the image forming unit 160.

In FIG. 16, when the printer 500 receives the start command (the printing data) from the host device, the fixing control unit 144 controls the fixing unit 170 to raise the temperature of the fixing roller 10 to the suitable temperature range for fixing, and waits the temperature rise of the fixing roller 10. When the temperature of the fixing roller 10 reaches the suitable temperature range, the main controller 145 sends the printing start command to the medium feeding control unit 142 and the image formation control unit 143.

Upon receiving the printing start command, the medium feeding control unit 142 controls the medium feeing unit 150 to start feeding the printing medium 1 (P3). A time after the medium feeding control unit 142 receives the printing start command and before the printing medium 1 reaches the toner transferring portion 5 is expressed as "t2".

The image formation control unit 143 drives the not shown drum motor to rotate the photosensitive drum 21, charges the surface of the photosensitive drum 21 (P1), exposes the surface of the photosensitive drum 21 (P2) to form the latent image, and develops the latent image to form the toner image which is transferable. A time after the image formation control unit 143 receives the printing start command and before the image forming unit 160 forms the transferable toner image is expressed as "t1". The image formation control unit 143 starts driving the drum motor after waiting for the image formation waiting time twg=(t2−t1) to pass. By providing such waiting time, the printing medium 1 meets the toner image on the photosensitive drum 21 (at the toner transferring portion 5) at a suitable timing. In other words, unnecessary rotation of the photosensitive drum 21 is reduced.

The waiting time reference table 400 of FIG. 11 stores data (in the form of a table) preliminarily obtained by the medium feeding waiting time twk (t1−t2) as shown in FIG. 15 and the image formation waiting time twg (t2−t1) as shown in FIG. 16.

In this embodiment, the image formation preparation time t1 has been described as the predetermined time. However, there is a case where the printer 500 is configured to shift from a normal mode to a power saving mode when the image formation is not performed for a predetermined time period. In such a case, the image formation preparation time t1 becomes longer when receiving the start command from the host device during a power saving mode than when receiving the start command from the host device during the normal mode. This is because the photosensitive drum 21 needs to be cleaned to remove residual toner therefrom in a shifting process from the power saving mode to the normal mode, so that the rotation amount of the photosensitive drum 21 needs to be increased for uniformly charging the surface thereof.

Therefore, when the printer 500 receives the start command from the host device during the power saving mode (i.e., the printer 500 is to perform first printing after returning from the power saving mode), the timing calculation unit 141 refers to a waiting time reference table of FIG. 17A (instead of the waiting time reference table of FIG. 11) in the step S420 of the timing determination process of FIG. 10. For example, in the waiting time reference table shown in FIG. 17A, the image formation waiting time is set to 4.8 seconds with respect to the "tray 5", and the image formation waiting time is set to 1.8 seconds with respect to the "tray 2".

Further, in the above description, the waiting time reference table of FIG. 11 has been described to store waiting times calculated under assumption that the printing speed (i.e., the feeding speed) of the printer 500 is constant. However, it is also possible to calculate the waiting time based on the printing speed that varies according to printing conditions such as a kind of the printing medium 1, environmental conditions, and a printing mode (for example, color printing or monochrome printing).

For example, as the thickness of the printing medium 1 is thicker, the printing speed becomes slower. Further, under a low temperature and low humidity environment (at a temperature of 10-15° C. and a humidity of 20-25%), the printing speed is slower than the printing speed under a high temperature and high humidity environment (at a temperature of 25-32° C. and a humidity of 55-80%) or a normal temperature and normal humidity environment (at a temperature of 15-25° C. and a humidity of 25-55%). Further, the printing speed in the color printing mode is slower than the printing speed in the monochrome printing mode.

Therefore, when the printing is performed on the printing medium thicker than a plain paper, when the printing is performed under the low temperature and low humidity environment, or when the printing is performed in the color printing mode, the timing calculation unit 141 refers to a waiting time reference table of 17B (instead of the waiting time reference table of FIG. 11) in the step S420 of the timing determination process of FIG. 10. For example, in the waiting time reference table shown in FIG. 17B, the image formation waiting time is set to 4 seconds with respect to the "tray 5", and the image formation waiting time is set to 0.4 seconds with respect to the "tray 2".

In this way, the waiting time reference table 400 can be set according to whether the printing is first performed after returning from the power saving mode, the thickness of the printing medium 1, the environmental condition (i.e., temperature and humidity), and the printing mode (i.e., color printing or monochrome printing), alone or in combination.

In order to check whether the thickness of the printing medium 1 is thicker than the plain paper, the tray information of FIG. 8 can be added with information (i.e., thickness information) regarding the thickness of the printing medium 1 with respect to each tray number. In this case, the medium feeding control unit 130 obtains the tray number of the medium tray 7 storing the target printing medium 1 and the thickness information of the target printing medium 1, and notifies the control unit 140 of the tray number and the thickness information. The control unit 140 determines whether the thickness of the printing medium 1 is thicker than the plain paper, based on the thickness information notified by the medium feeding control unit 130.

Further, in order to check whether the printing environment is the low temperature and low humidity temperature or not, a temperature sensor and a humidity sensor can be provided inside the printer 500. Based on signals outputted from the temperature sensor and the humidity sensor, the control unit 140 determines whether the printing environment is the low temperature and low humidity temperature or not.

Furthermore, the control unit 140 can determine whether the printing mode is the color printing or the monochrome printing, based on information contained in the printing data received from the host device.

As described above, according to the first embodiment, the timing of the image formation is determined based on the position of the medium tray 7 storing the printing medium 1 to be used. Therefore, the unnecessary rotation of the photosensitive drum 21 is reduced. Thus, the lifetime of the photosensitive drum 21 (i.e., the lifetime of the image forming unit) can be lengthened.

Second Embodiment

The second embodiment of the present invention will be described with reference FIGS. 18, 19 and 20. Components of the second embodiment that are the same as those of the first embodiment are assigned the same reference numerals, and duplicate explanations will be omitted.

Figure 18:
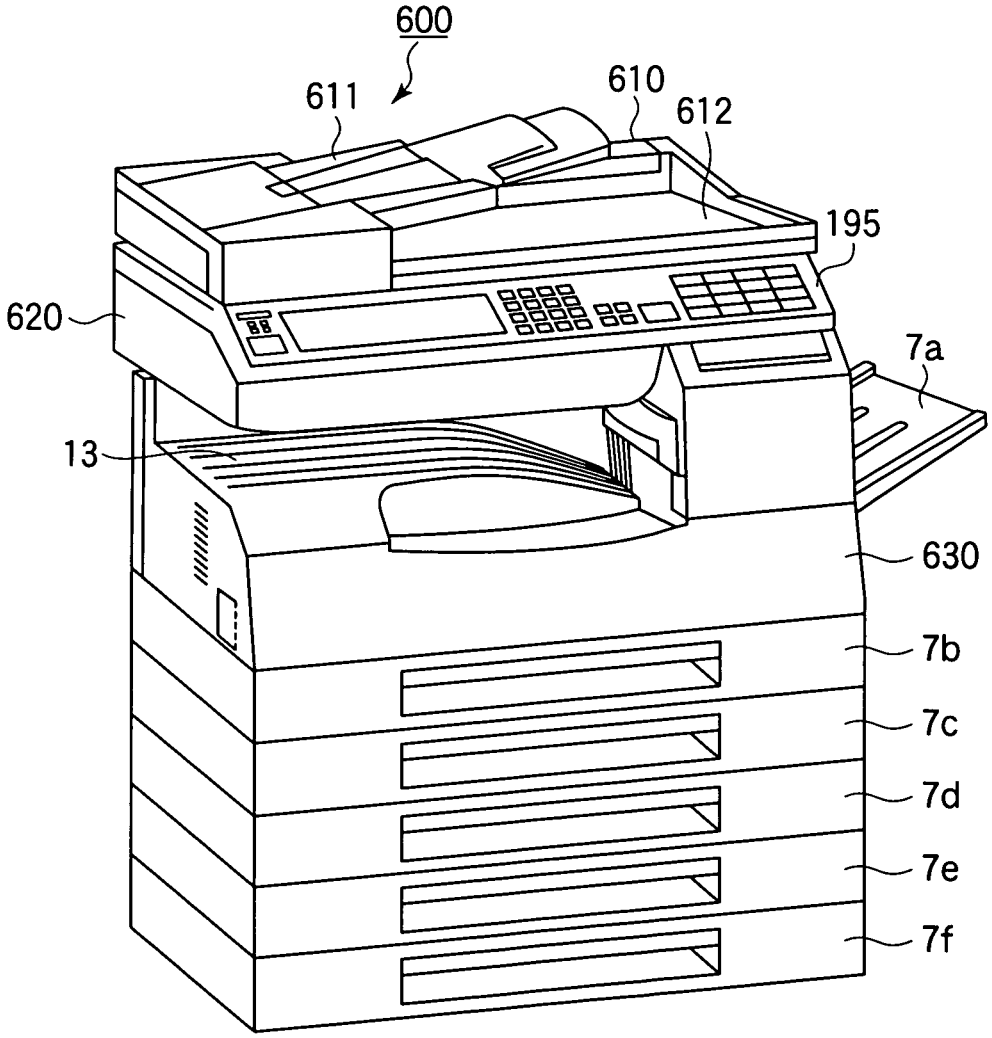
FIG. 18 is a perspective view showing an image processing apparatus according to the second embodiment.

FIG. 18 is a perspective view showing an outer shape of an image processing apparatus according to the second embodiment.

In FIG. 18, the image processing apparatus of the second embodiment is configured as a multifunctional peripheral (MFP) 600.

The MFP 600 includes an automatic document feeder (ADF) 610, an image reading unit 620, and an operation panel 195 (i.e., an operation/display unit) that performs input and output of information between a user and the MFP 600. The MFP 600 further includes an image forming section 630 having the same configuration as the printer 500 (FIG. 1) of the first embodiment. The image forming section 630 includes medium trays 7*a* through 7*f* having the same configurations as those of the printer 500 (FIG. 1) of the first embodiment.

Figure 19:
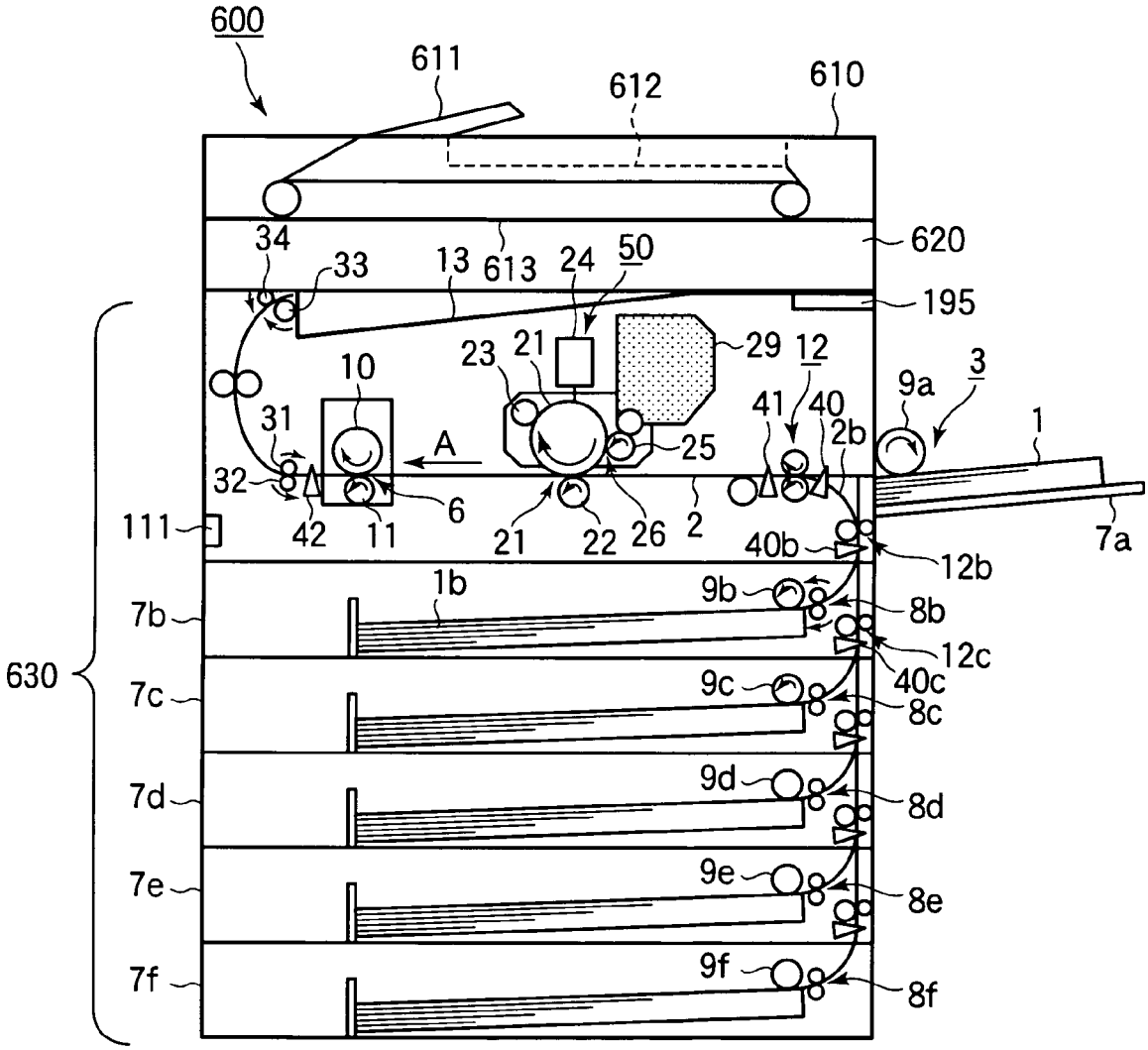
FIG. 19 is a side view schematically showing a configuration of the image processing apparatus according to the second embodiment.

FIG. 19 is a side view schematically showing the MFP 600 as the image processing apparatus according to the second embodiment.

In FIG. 19, the operation panel 195 has operation buttons or the like with which the use input information. The operation panel 195 has a display unit such as an LCD for displaying information to the user.

The ADF 610 includes a manuscript feeding tray 611 on which a plurality of manuscripts are placed. The ADF 610 further includes a roller (not shown) that separately feeds the manuscripts one by one to a predetermined manuscript reading position on a platen glass 613 of the image reading unit 620.

The image reading unit 620 includes a light source that emits a light to the manuscript on the manuscript reading position, and a photoelectric conversion element that receives the light reflected by the manuscript. The image reading unit 620 is configured to scan a manuscript image according to an inputted manuscript size, and to create an image data. The photoelectric conversion element converts the received light into electric signal (reading data), and creates the image data as digital data. The manuscript that has been read is further fed by the ADF 610, and is ejected to a manuscript ejection tray 612.

As described above, the MFP 600 includes the image forming section 630 having the same configuration as the printer 500 (FIG. 1). The components of the image forming section 630 of the MFP 600 are the same as those of the printer 500, and therefore assigned the same reference numerals.

Figure 20:
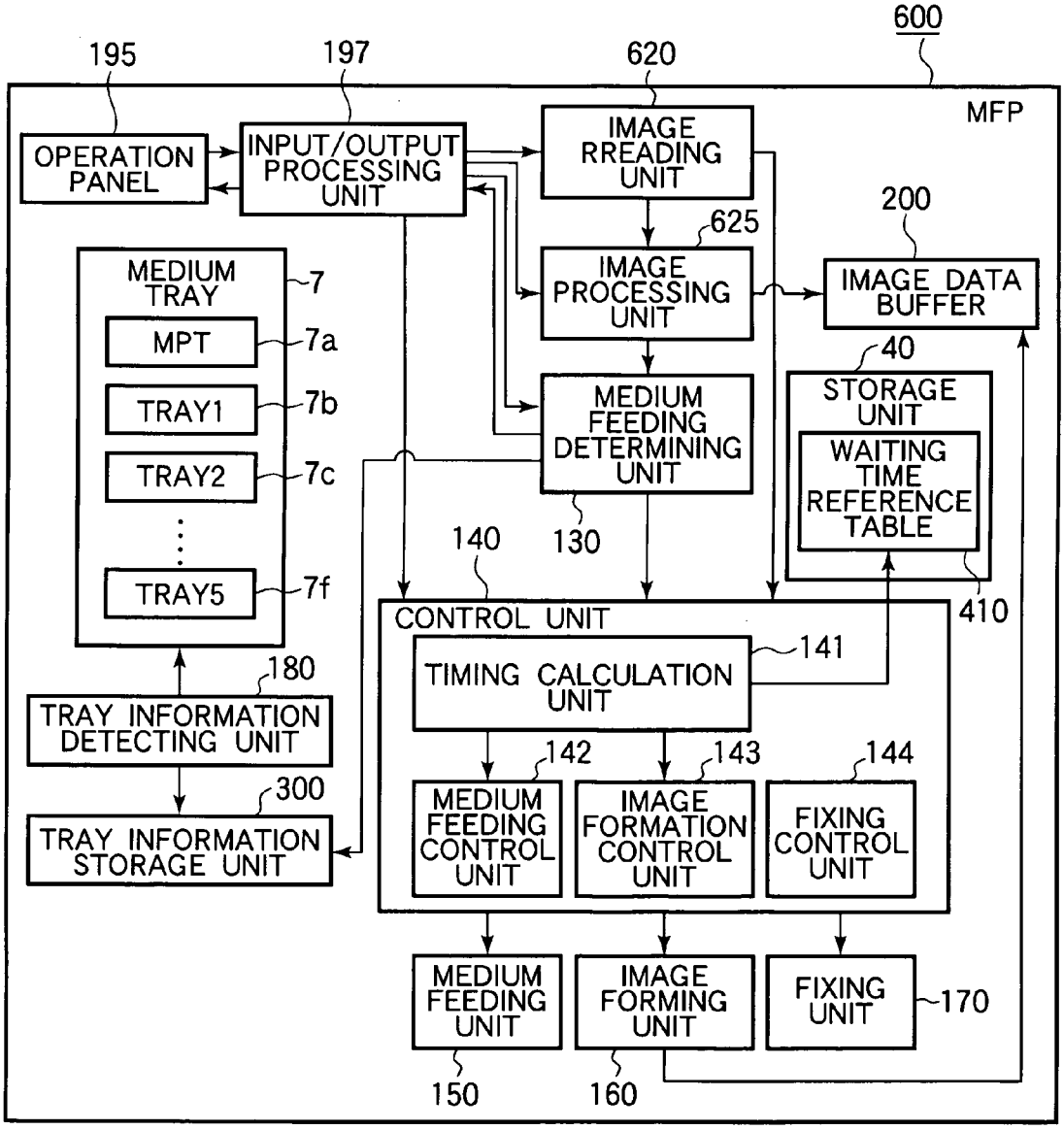
FIG. 20 is a block diagram showing a control system of the image processing apparatus according to the second embodiment.

FIG. 20 is a block diagram showing a control system of the MFP 600 as the image processing apparatus according to the second embodiment.

In FIG. 20, the MFP 600 includes the operation panel 195, an input/output processing unit 197, the image reading unit 620, an image processing unit 625, the medium feeding determining unit 130, and the control unit 140 (as an arithmetic unit and a control unit). The control unit 140 includes the timing calculation unit 141, the medium feeding control unit 142, the image formation control unit 143, and the fixing control unit 144. The MFP 600 further includes the medium feeding unit 150, the image forming unit 160, the fixing unit 170, the tray information detection unit 180, and the medium trays 7*a*, 7*b*, 7*c*, 7*d*, 7*e* and 7*f* (FIG. 19) collectively referred to as the medium trays 7. The MFP 600 further includes the image data buffer 200, the tray information storage unit 300, and the storage unit 40 which are accomplished using storage portions of a storage unit such as a nonvolatile memory. The storage unit 40 stores a waiting time reference table 410 as described later.

The operation panel 195 transfers data (inputted by the user) to the input/output processing unit 197. Further, when the operation panel 195 receives from the medium feeding determining unit 130 (via the input/output processing unit 197) a signal indicating that the selected medium tray 7 is out of printing medium 1, the operation panel 195 displays a message to prompt the user to replenish the printing medium 1 to the selected medium tray 7.

The input/output processing unit 197 evaluates the data transferred from the operation panel 195, and transfers the data to the image reading unit 620, the image processing unit 625, the medium feeding determining unit 130 or the control unit 140 based on content of the data. Further, if the input/output processing unit 197 receives from the medium feeding determining unit 130 a signal indicating that the selected medium tray 7 is out printing medium 1, the input/output processing unit 197 transfers the signal to the operation panel 195.

The image reading unit 620 reads the manuscript placed on the platen glass 613 by scanning the manuscript in a range notified by the input/output processing unit 197, and sends the image data (reading image data) to the image processing unit 625. Further, the image reading unit 620 notifies the control unit 140 of the start and termination of the reading respectively when the image reading unit 620 starts and terminates the reading.

The image processing unit 625 receives the image data from the image reading unit 620, creates an image data for printing by converting density, size or the like of the image data according to instruction of the user received via the input/output processing unit 197, and stores the image data in the image data buffer 200.

The medium feeding determining unit 130 receives the size of the printing medium 1 and number of output copies from the input/output processing unit 197. Further, the medium feeding determining unit 130 searches the tray information storage unit 300, and determines (selects) the medium tray 7 storing the printing medium 1 of the instructed size. If the selected medium tray 7 is out of printing medium 1, the medium feeding determining unit 130 sends to the input/output processing unit 197 a signal indicating the tray number of the selected medium tray 7 and indicating that the medium tray 7 is out of printing medium 1. If the selected medium tray 7 stores the printing medium 1, the medium feeding determining unit 130 notifies the control unit 140 of the tray number of the selected medium tray 7 and the number of output copies.

In the control unit 140, the timing calculation unit 141 refers to the waiting time reference table 410, based on the size of the manuscript and the tray number of the medium tray 1 storing the target printing medium 1. From the waiting time reference table 410, the timing calculation unit 141 calculates the image formation waiting time and the medium feeding waiting time. These waiting times are calculated in consideration of a time required for the image reading unit 620 to read the manuscript, the time (i.e., the medium feeding time) after the medium feeding unit 150 starts feeding the printing medium 1 and before the printing medium 1 reaches the toner transferring portion 5, and the time (i.e., the image formation preparation time) after the image forming unit 16 starts driving the photosensitive drum 21 and before the image forming unit 16 forms the transferable toner image. The timing calculation unit 141 notifies the medium feeding control unit 142 and the image formation control unit 143 respectively of the image formation waiting time and the medium feeding waiting time. In this regard, the waiting time reference table 410 stores the time required for reading manuscript with respect to each size of the manuscript (see, FIG. 28A), and the time required for feeding the printing medium 1 with respect to each medium tray 7 (see, FIG. 28B).

The control unit 140 notifies the medium feeding unit 150 of the tray number of the selected medium tray 7.

The control unit 140 receives from the image reading unit 620 a signal indicating that the image reading unit 620 starts reading the manuscript, and transfers the signal to the medium feeding control unit 142. Upon receiving the signal from the control unit 140, the medium feeding control unit 142 waits for the medium feeding waiting time to pass, and causes the medium feeding unit 150 to start feeding the printing medium 1. The medium feeding unit 150 feeds the printing medium 1 from the selected medium tray 7 at the instructed timing.

The control unit 140 receives from the image reading unit 620 a signal indicating that the image reading unit 620 terminates the reading of the manuscript, and transfers the signal to the image formation control unit 143. Upon receiving the signal from the control unit 140, the image formation control unit 143 waits for the image formation waiting time to pass, and causes the image forming unit 160 to start the image formation.

The image forming unit 160 reads the printing image data from the image data buffer 200, and forms an image on the photosensitive drum 21 at the received timing, and transfer the toner image to the printing medium 1 (which has been fed) at the toner transferring portion 5 described with reference to FIG. 19. This process is repeated by the number of output copies notified by the medium feeding determining unit 130.

The fixing unit 170 fixes the toner image (formed by the image forming unit 160) to the printing medium 1.

The tray information detecting unit 180 checks the respective medium trays 7*a* through 7*f* at predetermined timings. If an amount of the printing medium 1 or a setting of size or orientation of the printing medium 1 in any of the medium trays 7 changes, the tray information detecting unit 180 accesses the tray information storage unit 300, and rewrites the stored data. Therefore, the tray information storage unit 300 stores the size, orientation (and if necessary, material) and amount of the printing medium 1 in each of the medium trays 7*a* through 7*f*.

The control unit 140 controls an entire operation of the MFP 600 based on a control program (software) stored in a storage unit such as a memory. The control unit 140 has a timer or other time-counting means.

A function of the above configured MFP 600 will be described.

In this embodiment, when the MFP 600 performs a copy process, the medium feeding waiting time and the image formation waiting time are set in consideration of the time required for the image reading unit 620 to read the manuscript, the time required for the medium feeding unit 150 to feed the printing medium 1 from the selected medium tray 7 to the toner transferring portion 5, and the time required for the image forming unit 16 to complete the image formation preparation (i.e., to form a transferable toner image). For convenience of explanation, the fixing unit preparation waiting process (step S500 shown in FIG. 4) described in the first embodiment is omitted.

Figure 21:
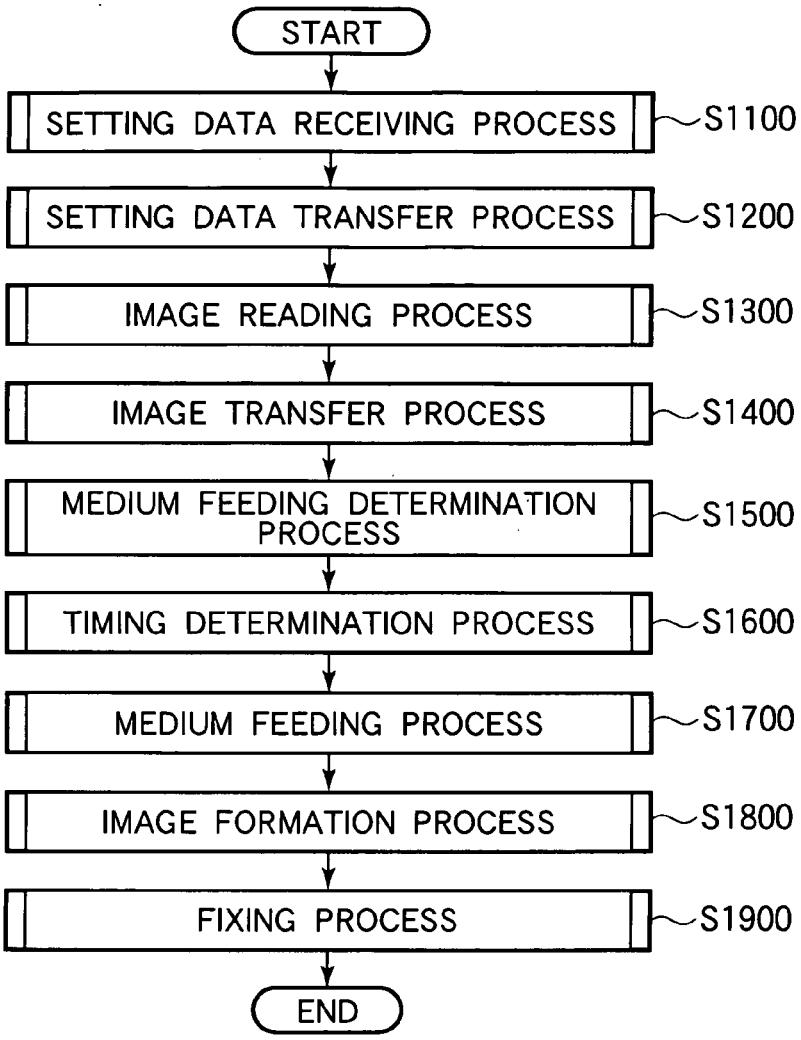
FIG. 21 is a flow chart showing a printing operation according to the second embodiment.

Next, the printing operation of the MFP 600 will be described with reference to FIG. 21 as well as FIGS. 19 and 20. FIG. 21 is a flow chart showing the printing operation of the second embodiment.

In a step S1100, the operation panel 195 of the MFP 600 performs a setting data receiving process to receive the data set by the user and to transfer the setting data to the input/output processing unit 197.

In a step S1200, the input/output processing unit 197 performs a setting data transferring process to transfer the setting data to an appropriate module according to the content of the received setting data.

In a step S1300, the image reading unit 620 reads the manuscript on the platen glass 613 in a range of a manuscript size received from the input/output processing unit 197, and transfers the image data (the reading image data) to the image processing unit 625.

In a step S1400, the image processing unit 625 receives the image data from the image reading unit 620, and performs an image converting process converting a density, size (enlargement or reduction) or the like of the image data according to the instruction by the user received at the input/output processing unit 197, create the image data for printing, and store the image data in the image data buffer 200.

In a step S1500, the medium feeding determining unit 130 performs the medium feeding determination process according to the size of the printing medium 1 instructed by the user to thereby determine (select) the medium tray 7 storing the printing medium 1 of the instructed size, and notify the control unit 140 of the tray number of the selected medium tray 7.

In a step S1600, the control unit 140 performs the timing determination process according to the manuscript size and the printing medium size instructed by the user to calculate the medium feeding waiting time and the image formation waiting time. Further, the control unit 140 notifies the medium feeding control unit 142 and the image formation control unit 143 respectively of the waiting times, and notifies the medium feeding unit 150 of the tray number of the selected medium tray 7.

In this regard, the control unit 140 monitors the fixing control unit 144. If the temperature of the fixing roller 10 rises to the suitable temperature range (i.e., the fixing unit 170 is operable), the control unit 140 sends the printing start command to the medium feeding control unit 142 and the image formation control unit 143.

In a step S1700, upon receiving the printing start command, the medium feeding control unit 142 causes the medium feeding unit 150 to start feeding the printing medium 1 from the selected medium tray 7 at the instructed timing.

In a step S1800, upon receiving the printing start command, the image formation control unit 143 causes the image forming unit 160 to perform the image formation process to form an image on the photosensitive drum 21 at the instructed timing and transfer the toner image to the printing medium 1 at the toner transferring portion 5.

In a step S1900, the fixing control unit 144 causes the fixing unit 170 to perform the fixing process to fix the toner image (transferred to the printing medium 1) to the printing medium 1. The MFP 600 ejects the printing medium 1 to which the toner image is fixed to the ejection tray 13, and the printing operation is completed.

Figure 22:
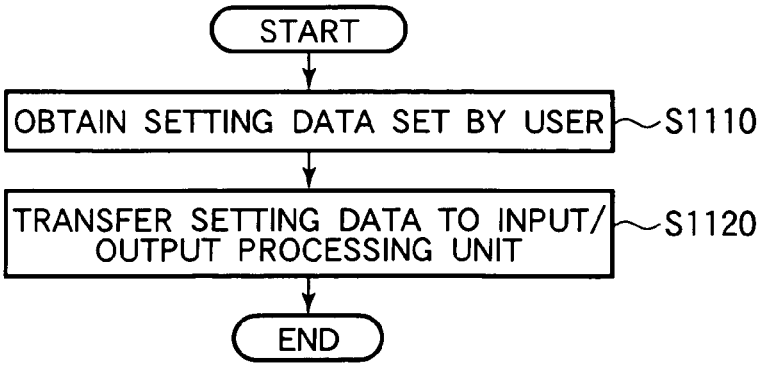
FIG. 22 is a flow chart showing a setting data receiving process according to the second embodiment.

Next, the setting data receiving process S1100 shown in FIG. 21 will be described with reference to FIG. 22 as well as FIG. 20. FIG. 22 is a flow chart showing the setting data receiving process according to the second embodiment. The setting data receiving process is performed by the operation panel 195.

In a step S1110, when the operation panel 195 receives the setting data such as an output density and a manuscript size set by the user, the operation panel 195 obtains the setting data.

In a step S1120, the operation panel 195 transfers the obtained setting data to the input/output processing unit 197.

Figure 23:
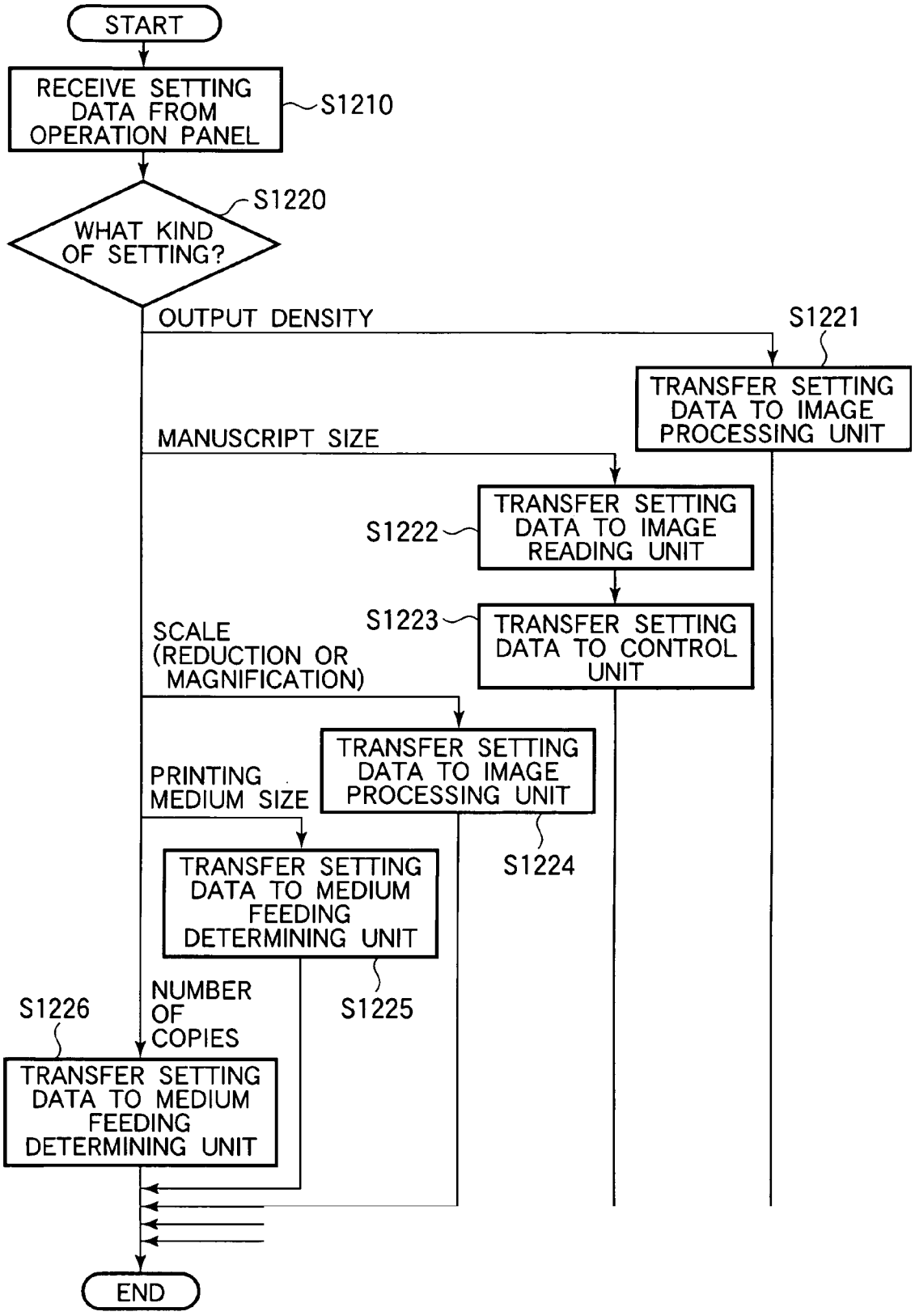
FIG. 23 is a flow chart showing a setting data transferring process according to the second embodiment.

Next, the setting data transferring process S1200 shown in FIG. 21 will be described with reference to FIG. 23 as well as FIG. 20. FIG. 23 is a flow chart showing the setting data transferring process according to the second embodiment. The setting data transferring process is performed by the input/output processing unit 197.

In a step S1210, the input/output processing unit 197 receives the setting data transferred from the operation panel 195.

In a step S1220, the input/output processing unit 197 transfers the setting data to an appropriate module according to the content of the received settings (i.e., the setting data).

In a step S1221, in the case where the setting data is output density, the input/output processing unit 197 transfers the output density to the image processing unit 625.

In a step S1222, in the case where the setting data is manuscript size, the input/output processing unit 197 transfers the manuscript size to the image reading unit 620.

In a step S1223, the input/output processing unit 197 further transfers the manuscript size to the control unit 140.

In a step S1224, in the case where the setting data is enlargement/reduction rate, the input/output processing unit 197 transfers the enlargement/reduction rate to the image processing unit 625.

In a step S1225, in the case where the setting data is printing medium size, the input/output processing unit 197 transfers the printing medium size to the medium feeding determining unit 130.

In a step S1226, in the case where the setting data is number of output copies, the input/output processing unit 197 transfers the number of output copies to the medium feeding determining unit 130.

Figure 24:
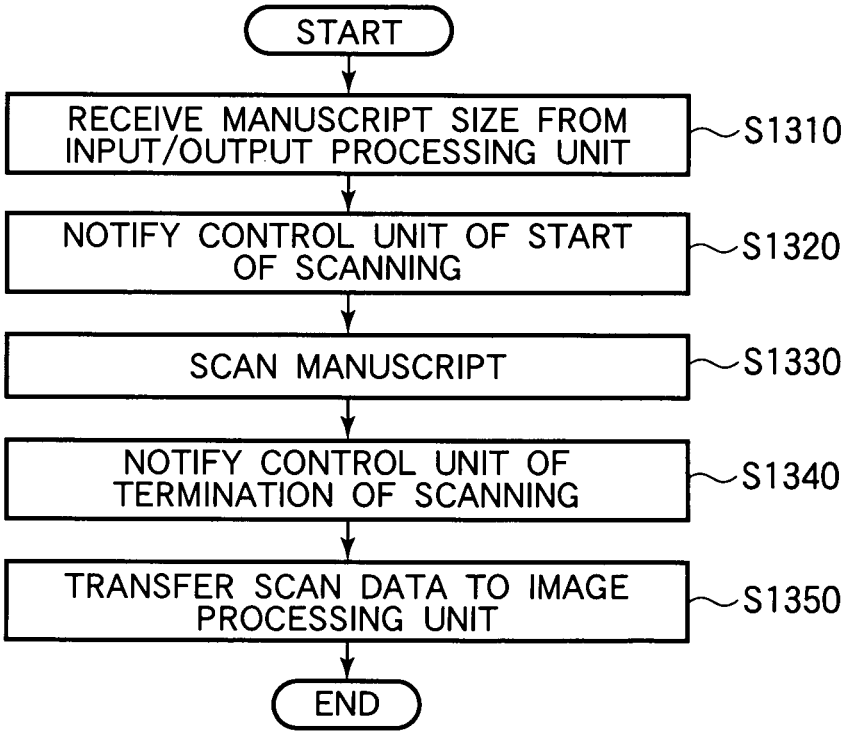
FIG. 24 is a flow chart showing an image reading process according to the second embodiment.

Next, the image reading process S1300 shown in FIG. 21 will be described with reference to FIG. 24 as well as FIG. 20. FIG. 24 is a flow chart showing the image reading process according to the second embodiment. The image reading process is performed by the image reading unit 620.

In a step S1310, the image reading unit 620 receives the manuscript size from the input/output processing unit 197.

In a step S1320, the image reading unit 620 notifies the control unit 140 that the image reading unit 620 starts scanning.

In a step S1330, the image reading unit 620 scans the manuscript placed on the platen glass 613 in a range of the received manuscript size.

In a step S1340, the image reading unit 620 terminates the scanning, and notifies the control unit 140 of the termination of the scanning.

In a step S1350, the image reading unit 620 transfers the scan data (i.e., reading image data) to the image processing unit 625.

Figure 25:
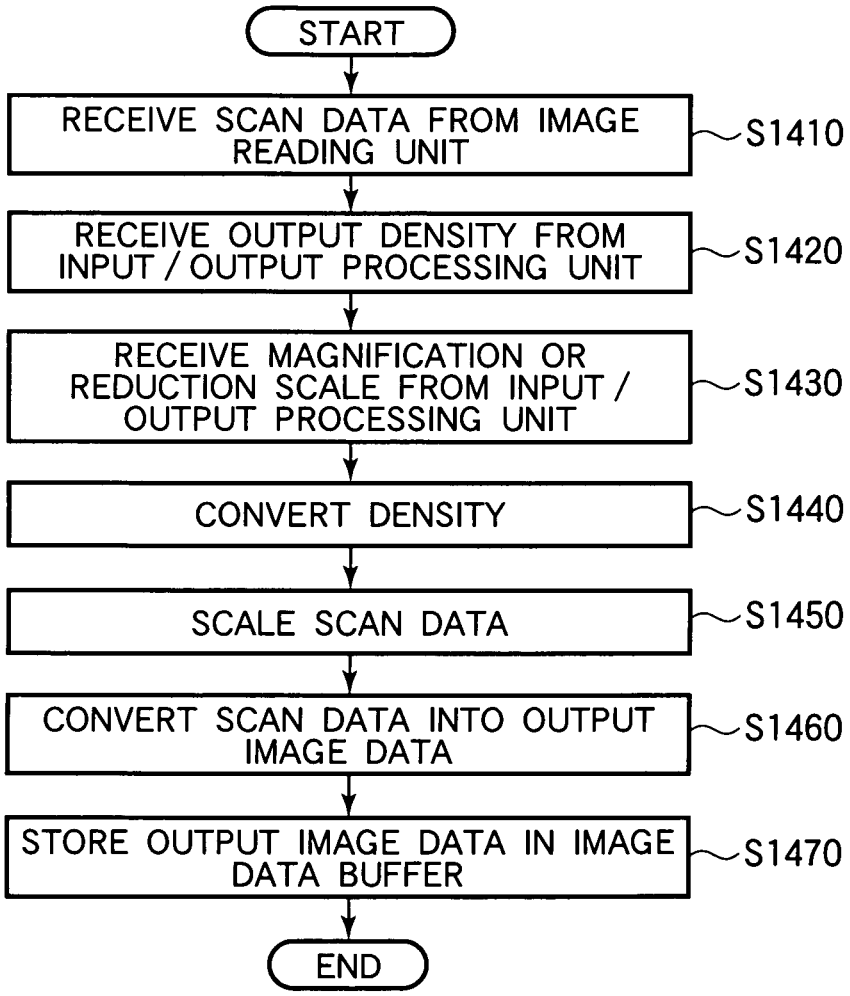
FIG. 25 is a flow chart showing an image converting process according to the second embodiment.

Next, the image converting process S1400 shown in FIG. 21 will be described with reference to FIG. 20 and FIG. 25. FIG. 25 is a flow chart showing the image converting process according to the second embodiment. The image converting process is performed by the image converting unit 625.

In a step S1410, the image converting unit 625 receives the scan data from the image reading unit 620.

In a step S1420, the image converting unit 625 receives the output density from the input/output processing unit 197.

In a step S1430, the image converting unit 625 receives the enlargement/reduction rate from the input/output processing unit 197.

In a step S1440, the image converting unit 625 performs a density correction according to the output density received at the step S1420.

In a step S1450, the image converting unit 625 performs enlargement or reduction processing on the scan data received at the step S1410 according to the enlargement/reduction rate received at the step S1420.

In a step S1460, the image converting unit 625 converts the scan data into the output image data for printing (i.e., printing image data).

In a step S1470, the image converting unit 625 stores the output image data in the image data buffer 200.

Figure 26:
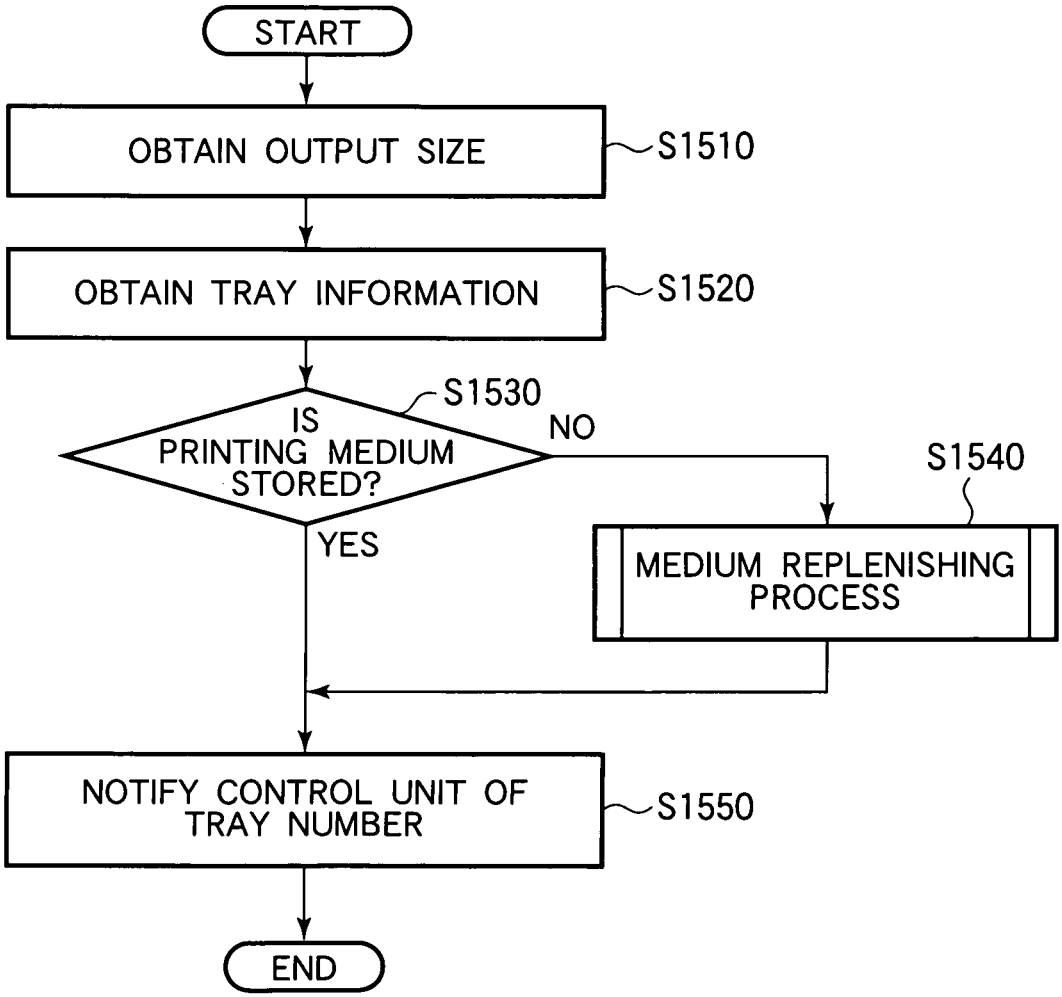
FIG. 26 is a flow chart showing a medium feeding determination process according to the second embodiment.

Next, the medium feeding determination process S1500 shown in FIG. 21 will be described with reference to FIG. 26 as well as FIG. 20. FIG. 26 is a flow chart showing the medium feeding determination process according to the second embodiment. The medium feeding determination process is performed by the medium feeding determining unit 130.

In a step S1510, the medium feeding determining unit 130 obtains the size of the printing medium 1 to be outputted from the input/output processing unit 197.

In a step S1520, the medium feeding determining unit 130 refers to the tray information storage unit 300 based on the size of the printing medium 1 (obtained at the step S1510), and obtains the tray information. The tray information contains the tray number identifying the medium tray 7 storing the printing medium 1 of the instructed size, and a rough amount of the printing media 1 stored therein. The tray information stored in the tray information storage unit 300 is the same as that in the first embodiment (FIG. 8).

In a step S1530, the medium feeding determining unit 130 determines, based on the tray information, whether the target printing medium 1 is stored in the selected medium trays 7. If the medium feeding determining unit 130 determines that the target printing medium 1 is stored in the selected medium tray 7, the medium feeding unit 130 proceeds to a step S1550. If the medium feeding determining unit 130 determines that the selected medium tray 1 is out of printing medium 1, the medium feeding unit 130 proceeds to a step S1540.

In the step S1540, the medium feeding determining unit 130 performs the medium replenishing process. The medium replenishing process is the same as that of the first embodiment (FIG. 9).

In the step S1550, the medium feeding determining unit 130 notifies the control unit 140 of tray number of the selected medium tray 7, and the medium feeding determination process is completed.

Figure 27:
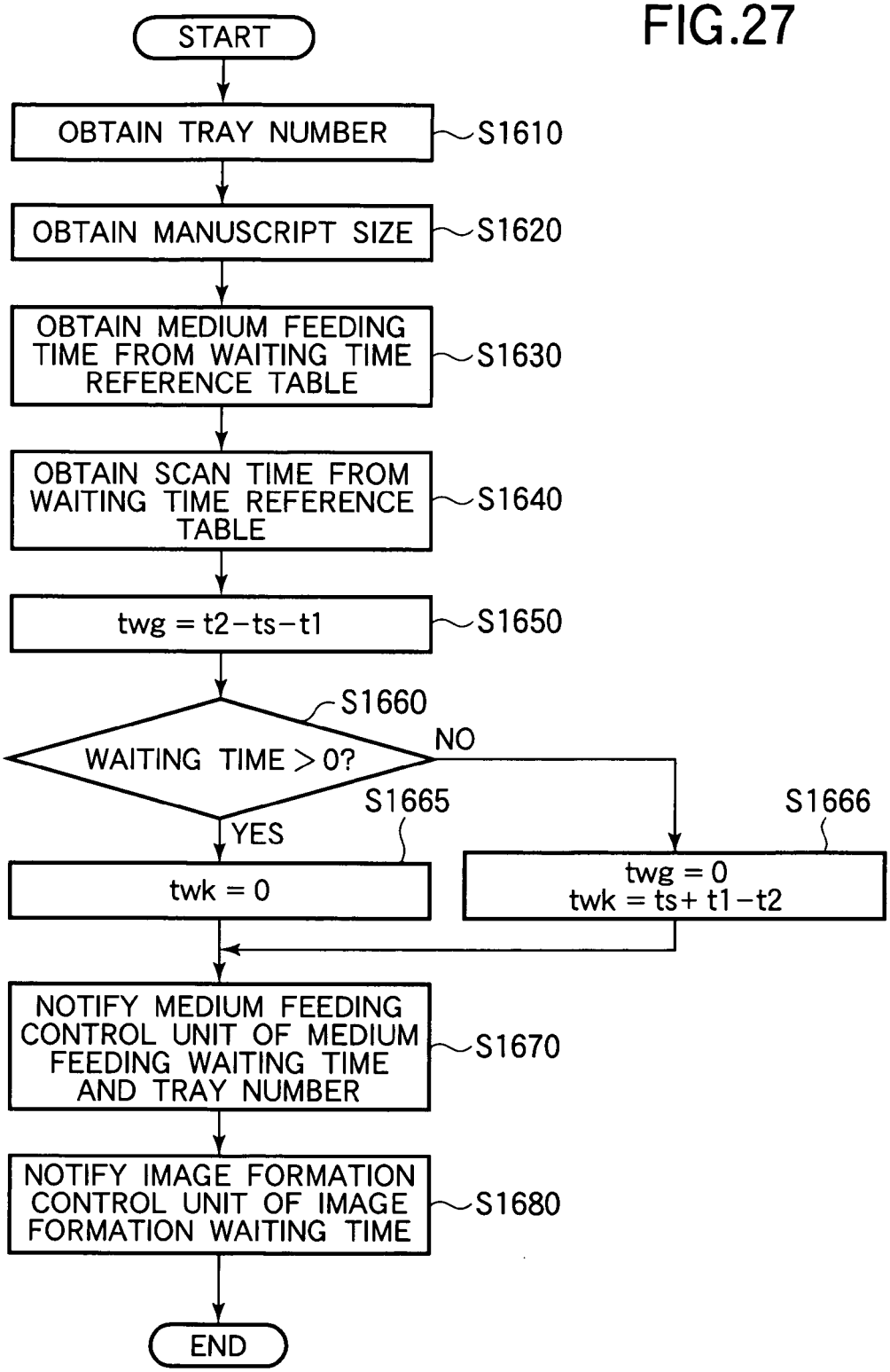
FIG. 27 is a flow chart showing a timing determination process according to the second embodiment.

Next, the timing determination process S1600 shown in FIG. 21 will be described with reference to FIG. 27 as well as FIG. 20. FIG. 27 is a flow chart showing the timing determination process of the second embodiment. The timing determination process is performed by the control unit 140 activating the timing calculation unit 141.

In a step S1610, the control unit 140 obtains the tray number from the medium feeding determining unit 130.

In a step S1620, the control unit 140 obtains the manuscript size from the input/output processing unit 197.

In a step S1630, the control unit 140 activates the timing calculation unit 141 using the tray number and the manuscript size as argument. The timing calculation unit 141 refers to the waiting time reference table 410 using the tray number, and obtains the time required for feeding the printing medium 1 (i.e., medium feeding time) from the selected medium tray 7.

In a step S1640, the timing calculation unit 141 refers to the waiting time reference table 410 using the manuscript size, and obtains the time required for scanning the manuscript (i.e., scanning time) with respect to the instructed manuscript size.

Here, an example of the waiting time reference table 410 will be described. FIGS. 28A and 28B show examples of the waiting time reference table 410 of the second embodiment.

The waiting time reference table 410 contains a table of the medium feeding time with respect to each medium tray 7 (FIG. 28A) and a table of the scanning time with respect to each manuscript size (FIG. 28B).

The medium feeding time (set with respect to each medium tray 7) is a time after the printing medium 1 is picked up and fed from the medium tray 7 and before the printing medium 1 reaches the toner transferring portion 5. For example, in the case of the printing medium 1 stored in the "tray 2", the medium feeding time after the printing medium 1 is picked up and before the leading end of the printing medium 1 reaches the toner transferring portion 5 is 2 seconds, as shown in FIG. 28A.

The scanning time (set with respect to each manuscript size) is a time after the manuscript reading unit 620 starts scanning the manuscript of a certain size and before the manuscript reading unit 620 terminates the scanning. For example, the scanning time required for scanning the manuscript of A3 size is 3 seconds, as shown in FIG. 28B.

In a step S1650, the timing calculation unit 141 calculates the image formation waiting time using the obtained medium feeding time and the image formation preparation time. Here, the image formation preparation time is a time after the drum motor of the image forming unit 160 is driven to rotate the photosensitive drum 21 (so that the photosensitive drum 21 is charged, exposed and developed) and before the developed image reaches the toner transferring portion 5. In this embodiment, the image formation preparation time t1 is a unique value to each MFP 600.

The image formation waiting time twg is determined based on the image formation preparation time t1, the medium feeding time t2, and the scanning time is as follows.

Figure 29:
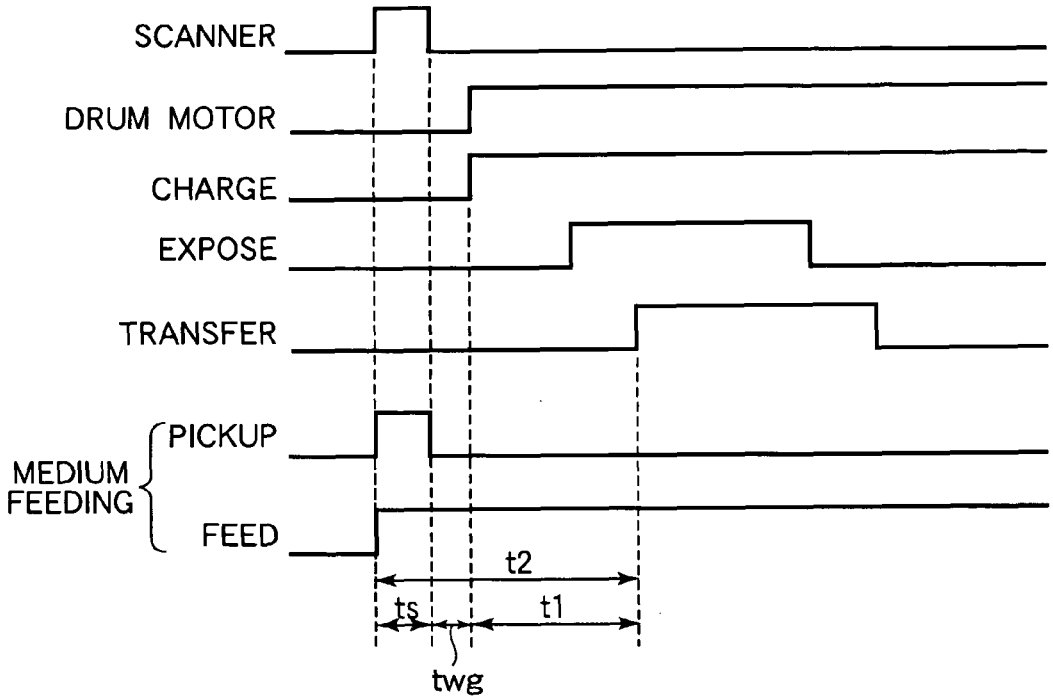
FIG. 29 is a timing chart showing medium feeding and image formation according to the second embodiment.

In a timing chart shown in FIG. 29, the medium feeding time t2 (seconds) is defined as a time required for the medium feeding unit 150 to feed the printing medium 1 to the toner transferring portion 5 under assumption that the medium feeding unit 150 start the medium feeding at the same time when the image reading unit 620 start scanning. Further, the image formation preparation time t1 (seconds) is defined as a time required for the image forming unit 160 to complete the image formation preparation (i.e., to form a transferable toner image) under assumption that the image forming unit 160 completes the image formation preparation at the same time when the printing medium 1 reaches to the toner transferring portion 5. In this case, if the medium feeding time t2 is longer than the image formation preparation time t1 (i.e., t2>t1), the image forming unit 160 must wait for (t2−t1) seconds to pass until the printing medium 1 reaches the toner transferring portion. In such a case, the photosensitive drum 21 needs to rotate unnecessarily for (t2−t1) seconds.

Therefore, according to this embodiment, the image forming unit 160 starts the image formation preparation (i.e., starts rotating and charging the photosensitive drum 21) after waiting for a certain waiting time after the image reading unit 620 terminates the scanning.

The image formation waiting time twg (seconds) is calculated using the above described scanning time ts (i.e., third time), the image formation preparation time t1 (i.e., first time) and the medium feeding time t2 (i.e., second time) as follows:

$$twg = t2 - ts - t1$$

In a step S1650, the timing calculation unit 141 determines whether the calculated image formation waiting time twg is greater than 0 nor not. If the image formation waiting time twg is determined to be greater than 0, the timing calculation unit 141 proceeds to a step S1665. If the image formation waiting time twg is determined to be less than 0, the timing calculation unit 141 proceeds to a step S1666.

In the step S1665, the timing calculation unit 141 sets the medium feeding waiting time to 0 second. This is because, in this case, the image formation waiting time twg is set to a value greater than 0.

In a step S1666, the image formation waiting time twg is set to 0 second. This is because, in this case, the medium feeding time t2 is shorter than the sum of the scanning time ts and the image formation preparation time t1, and therefore the medium feeding waiting time twk is set to a value greater than 0.

Figure 30:
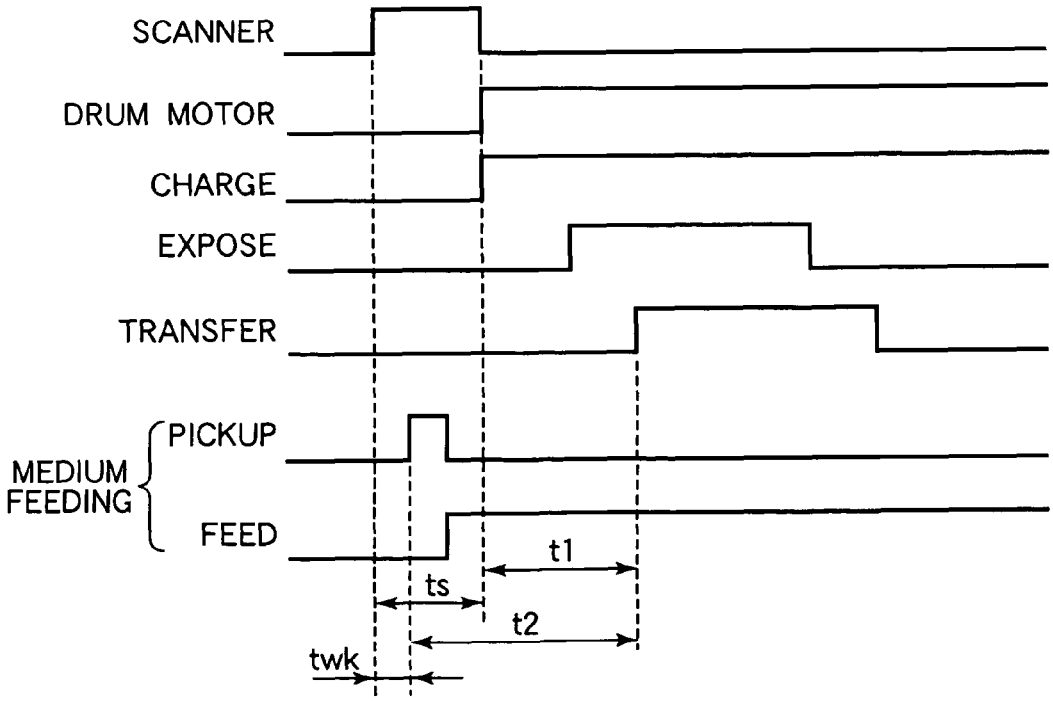
FIG. 30 is another timing chart showing the medium feeding and the image formation according to the second embodiment.

In a timing chart shown in FIG. 30, the medium feeding waiting time twk is calculated using the above described image formation preparation time t1, the medium feeding time t2 and the scanning time ts (seconds) as follows:

$$twk=ts+t1-t2$$

In a step S1670, when the medium feeding waiting time twk and the image formation waiting time twg are determined as above, the timing calculation unit 141 notifies the medium feeding control unit 142 of the medium feeding waiting time twk and the tray number of the selected medium tray 7.

In a step S1680, the timing calculation unit 141 notifies the image formation control unit 143 of the image formation waiting time twg, and the timing determination process is completed.

Figure 31:
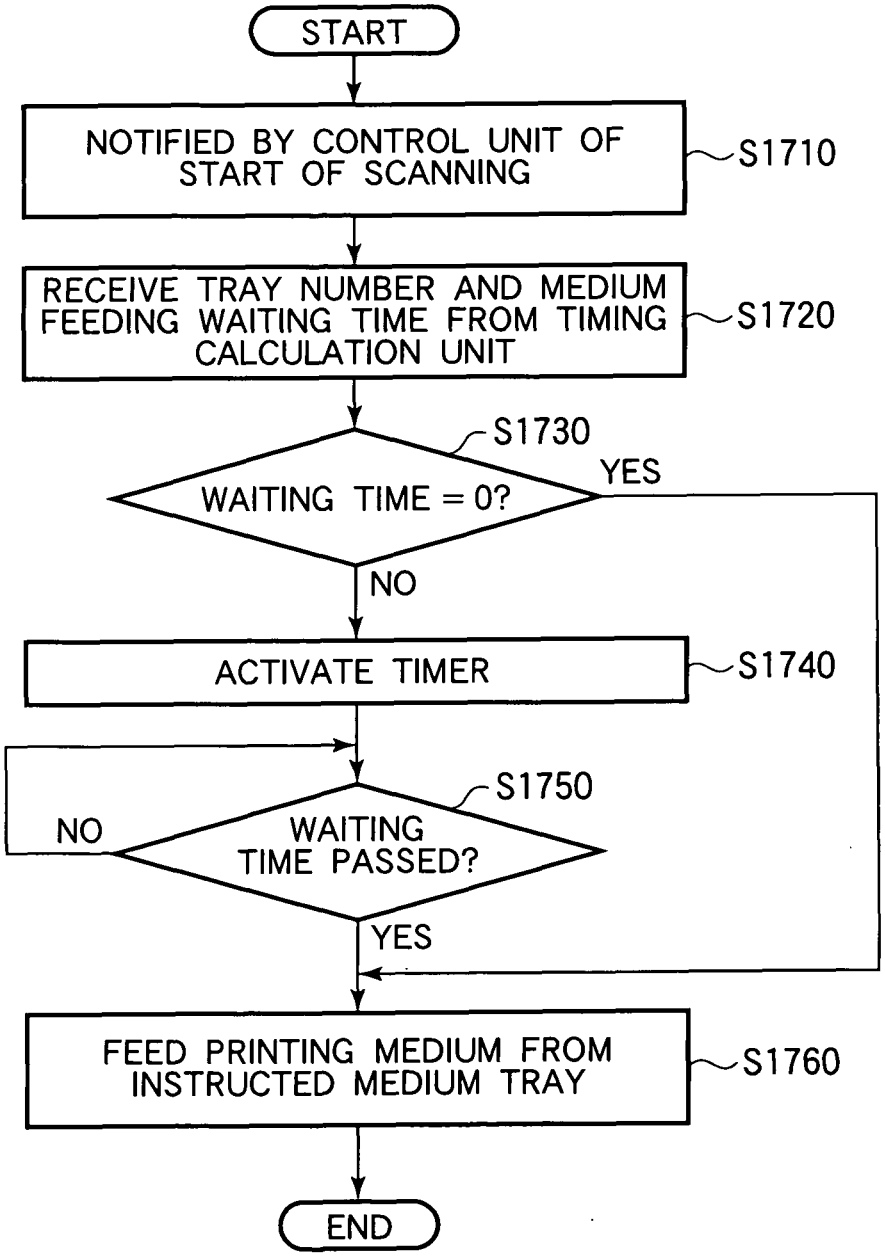
FIG. 31 is a flow chart showing a medium feeding process according to the second embodiment.

Next, the medium feeding process S1700 shown in FIG. 21 will be described with reference to FIG. 31 as well as FIG. 20. FIG. 31 is a flow chart showing the medium feeding process of the second embodiment. The medium feeding process is performed by the medium feeding unit 150 under control of the medium feeding control unit 142.

In a step S1710, the medium feeding control unit 142 is notified by the control unit 140 that the image reading unit 620 starts the scanning.

In a step S1720, the medium feeding control unit 142 obtains from the timing calculation unit 141 of the tray number and the medium feeding waiting time (twk).

In a step S1730, if the obtained medium feeding waiting time (twk) is less than or equal to 0, the medium feeding control unit 142 proceeds to a step S1760, and starts feeding the printing medium 1. If the obtained medium feeding waiting time (twk) is greater than 0, the medium feeding control unit 142 proceeds to a step S1740.

In a step S1740 (in the case where the medium feeding waiting time is greater than 0), the medium feeding control unit 142 starts the timer.

In a step S1750, the medium feeding control unit 142 waits for the medium feeding waiting time (twk) to pass, using the timer.

In a step S1760 (as the medium feeding waiting time passes), the medium feeding control unit 142 causes the medium feeding unit 150 to start feeding the printing medium 1 from the selected medium tray 7.

Figure 32:
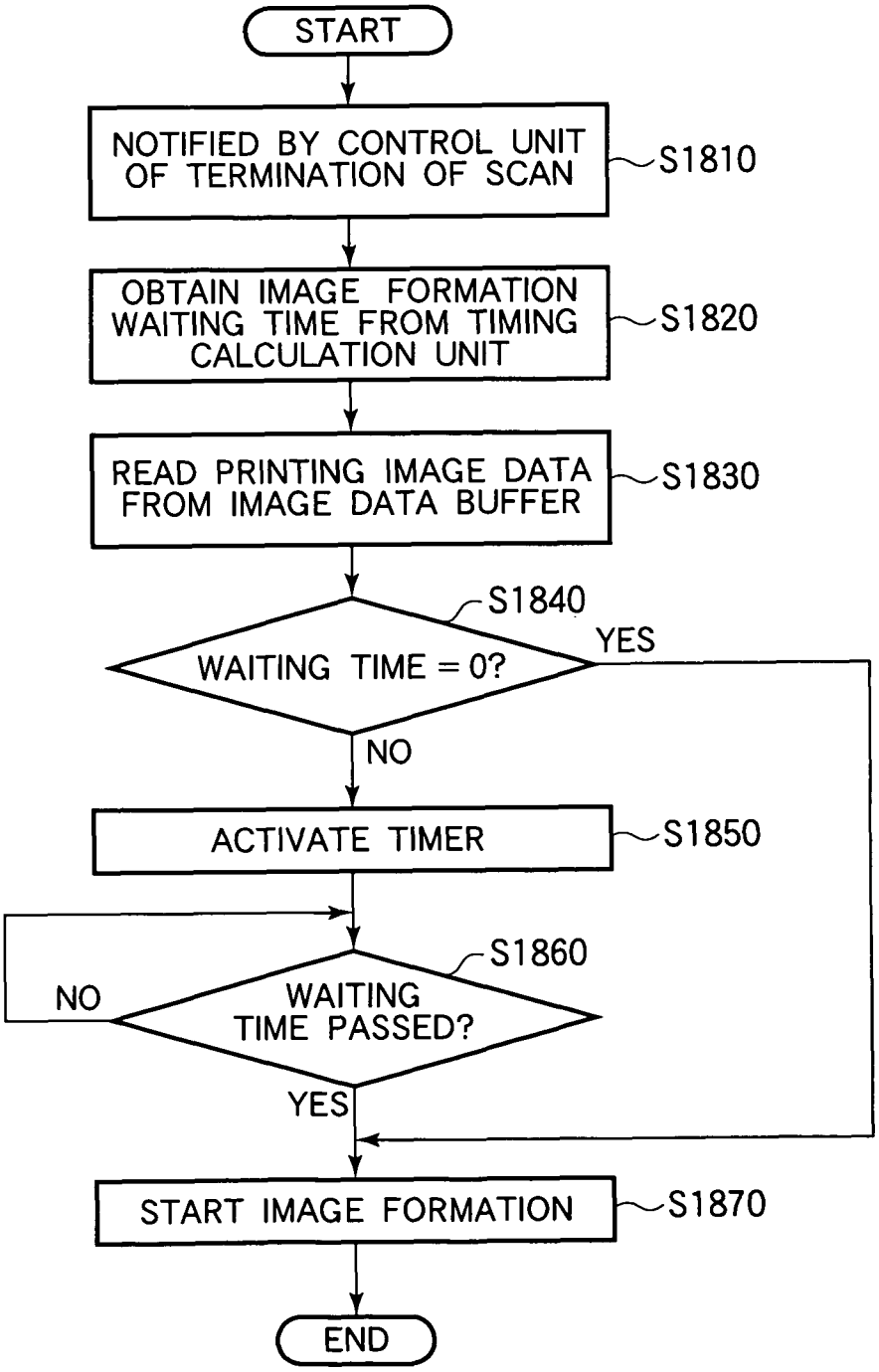
FIG. 32 is a flow chart showing an image formation process according to the second embodiment.

Next, the image formation process S1800 shown in FIG. 21 will be described with reference to FIG. 32 as well as FIG. 20. FIG. 32 is a flow chart showing the image formation process of the second embodiment. The image formation process is performed by the image forming unit 160 under control of the image formation control unit 143.

In a step S1810, the image formation control unit 143 is notified by the control unit 140 that the image reading unit 620 terminates the scanning.

In a step S1820, the image formation control unit 143 obtains the image formation waiting time (twg) from the timing calculation unit 141.

In a step S1830, the image formation control unit 143 accesses the image data buffer 200 irrespective of the waiting time, and reads the printing image data from the image data buffer 200 to prepare for image formation.

In a step S1840, the image formation control unit 143 determines whether the obtained image formation waiting time (twg) is greater than 0 or not. If the image formation waiting time is less than or equal to 0, the image formation control unit 143 proceeds to a step S1870. If the image formation waiting time is greater than 0, the image formation control unit 143 proceeds to a step S1850.

In the step S1850 (i.e., in the case where the image formation waiting time is greater than 0), the image formation control unit 143 starts the timer.

In a step S1860, the image formation control unit 143 waits for the image formation waiting time (twg) to pass, using the timer.

In the step S1870, the image formation control unit 143 starts image formation based on the printing image data (read at the step S1830).

With the above described processes, the toner image is formed on the printing medium 1. Then, the printing medium 1 passes the fixing unit 6 (FIG. 19), is carried by the carrying rollers 31 and 32, and is ejected by the ejection rollers 33 and 34 to the ejection tray 13.

As described in the first embodiment, the waiting times stored in the waiting time reference table 410 can be set according to the printing speed. Further, the waiting times stored in the waiting time reference table 410 can be set according to whether the printing is first performed after returning from the power saving mode, the thickness of the printing medium 1, the environmental condition (i.e., temperature and humidity), and the printing mode (i.e., color printing or monochrome printing), alone or in combination.

As described above, according to the second embodiment, the timing of image formation is determined based on the scanning time ts, the medium feeding time t2 and the image formation preparation time t1, with the result that the unnecessary rotation of the photosensitive drum 21 is reduced. Thus, it becomes possible to lengthen the lifetime of the photosensitive drum 21 even in the image processing apparatus (such as MFP) having relatively expensive parts.

In the first and second embodiment, the printer and the MFP have been described as examples of the image processing apparatus. However, the present invention is not limited to these apparatuses, but is applicable to a facsimile machine, a copier, or other apparatus that forms an image using electrophotography.

While the preferred embodiments of the present invention have been illustrated in detail, it should be apparent that modifications and improvements may be made to the invention without departing from the spirit and scope of the invention as described in the following claims.

What is claimed is:

1. An image processing apparatus comprising:

a plurality of medium storage portions including a first medium storage portion and a second medium storage portion;

a medium feeding unit that feeds a medium from any one of said plurality of medium storage portions;

an image forming unit that performs image formation and thereby forms an image on said medium fed by said medium feeding unit;

a storage unit that stores a medium feeding waiting time and an image formation waiting time; and a control unit that controls said image forming unit and said medium feeding unit;

wherein when said control unit starts an operation to form an image on said medium after receiving printing data, said control unit selects one of said plurality of medium storage portions;

wherein said control unit controls a timing to start image formation by said image forming unit and a timing to start feeding said medium by said medium feeding unit at different timings, based on which of the first medium storage portion and the second medium storage portion is selected;

wherein in the case in which said first medium storage portion is selected, the timing to start feeding said medium by said medium feeding unit is earlier than the timing to start image formation by said image forming unit; and wherein in the case in which said second medium storage portion is selected, the timing to start image formation by said image forming unit is earlier than the timing to start feeding said medium by said medium feeding unit.

2. The image processing apparatus according to claim 1, wherein said image formation waiting time is obtained by subtracting a first time required for said image forming unit to form an image transferable to said medium from a second time required for said medium feeding unit to feed said medium from said medium storage portion to said image forming unit.

3. The image processing apparatus according to claim 2, wherein said image forming unit includes a latent image bearing body that bears a latent image; and wherein said first time is a time required for said latent image bearing body to be charged, exposed, developed and rotated to cause a developed image to reach a transferring portion where said developing image is to be transferred to said medium.

4. The image processing apparatus according to claim 1, further comprising a determining unit that determines which of said medium storage portions stores said medium to be used;

wherein said storage unit stores image formation waiting times respectively with respect to said medium storage portions; and wherein said control unit determines said time interval based on said image formation waiting time with respect to said medium storage portion determined by said determining unit.

5. The image processing apparatus according to claim 4, wherein said storage unit stores medium feeding waiting times respectively with respect to said medium storage portions, in addition to said image formation waiting times;

wherein each of said medium feeding waiting time is obtained by subtracting a second time required for said medium feeding unit to feed said medium from each medium storage portion to said image forming unit from a first time required for said image forming unit to form an image transferable to said medium; and wherein said control unit causes said medium feeding unit to wait for a time interval based on said medium feeding waiting time, after said image forming unit starts image formation.

6. The image processing apparatus according to claim 1, wherein said image formation waiting time becomes longer as a distance from said image forming unit to said medium storage portion increases.

7. The image processing apparatus according to claim 1, further comprising an image reading unit that reads a manuscript;

wherein said image formation waiting time is obtained by subtracting a first time required for said image forming unit to form an image transferable to said medium and a third time required for said image reading unit to read said manuscript from a second time required for said medium feeding unit to feed said medium from said medium storage portion to said image forming unit.

8. The image processing apparatus according to claim 7, further comprising a determining unit that determines which of said medium storage portions stores said medium to be used;

wherein said storage unit stores image formation waiting times respectively with respect to said medium storage portions; and wherein said control unit determines said time interval based on said image formation waiting time with respect to said medium storage portion determined by said determining unit.

9. The image processing apparatus according to claim 7, wherein said image formation waiting time becomes longer as a distance from said image forming unit to said medium storage portion increases.

10. The image processing apparatus according to claim 7, further comprising a determining unit that determines which of said medium storage portions stores said medium to be used;

wherein said storage unit stores medium feeding waiting times respectively with respect to said medium storage portions, in addition to said image formation waiting times;

wherein each of said medium feeding waiting times is obtained by subtracting a second time required for said medium feeding unit to feed said medium from each medium storage portion to said image forming unit and a third time required for said image reading unit to read said manuscript from a first time required for said image forming unit to form an image transferable to said medium; and wherein, when said medium feeding waiting time with respect to said medium storage portion determined by said determining unit is greater than 0, said control unit determines a time interval after said image forming unit starts image formation and before said medium feeding unit starts feeding said medium, based on said medium feeding waiting time.

11. The image processing apparatus according to claim 1, wherein said image formation waiting time stored in said storage unit is determined based on a condition of image formation by said image forming unit.

12. The image processing apparatus according to claim 11, wherein said condition is a feeding speed of said medium.

13. The image processing apparatus according to claim 11, wherein said condition includes at least one of:

whether said image forming unit first performs image formation after returning from a power saving mode;

a thickness of said medium;

a temperature and humidity; and whether said image forming unit performs a color printing or monochrome printing.

14. An image processing apparatus comprising:

an image forming unit that performs image formation and thereby forms an image on a medium;

a plurality of medium supply portions for supplying said medium to said image forming unit, said plurality of medium supply portions including a first medium supply portion and a second medium supply portion; and a control unit that instructs one of said plurality of medium supply portions to supply said medium, and instructs said image forming unit to perform image formation;

wherein when said control unit starts an operation to form an image on said medium after receiving printing data, said control unit changes a relationship between a timing to start supplying said medium by said one of said medium supply portions and a timing to start image formation by said image forming unit, based on which of said plurality of medium supply portions is instructed to supply said medium;

wherein said control unit controls a timing to start image formation by said image forming unit and a timing to start supplying said medium by said one of said plurality of medium supply portions at different timings, based on which of the first medium supply portion and the second supply portion is instructed to supply said medium;

wherein in the case in which said first medium supply portion is instructed to supply said medium, the timing to start supplying said medium by said first medium supply portion is earlier than the timing to start image formation by said image forming unit; and wherein in the case in which said second medium supply portion is instructed to supply said medium, the timing to start image formation by said image forming unit is earlier than the timing to start supplying said medium by said second medium supply unit.

15. The image processing apparatus according to claim 14, wherein said control unit determines a difference between a timing at which said control unit instructs said one of said medium supply portions to start supplying said medium and a timing at which said control unit instructs said image forming unit to start image formation, based on which of said medium supply portions is instructed to supply said medium.

16. The image processing apparatus according to claim 15, further comprising a storage unit that stores information on a time interval for each of said plurality of medium supply portions, said time interval being an interval between said timing at which said control unit instructs said one of said medium supply portions to start supplying said medium and said timing at which said control unit instructs said image forming unit to start image formation;

wherein said control unit determines said difference between said timing at which said control unit instructs said one of said medium supply portions to start supplying said medium and said timing at which said control unit instructs said image forming unit to start image formation by reading out information on said time interval corresponding to said medium supply portion instructed to supply said medium from said storage portion.

17. The image processing apparatus according to claim 16, wherein:

when said medium supply portion instructed to supply said medium is farther from said image forming unit, said control unit instructs said image forming unit to start image formation after said control unit instructs said medium supply portion to supply said medium; and when said medium supply portion instructed to supply said medium is closer to said image forming unit, said control unit instructs said medium supply portion to supply said medium after said control unit instructs said image forming unit to start image formation.

18. The image processing apparatus according to claim 14, wherein said timing at which said image forming unit starts image formation is a timing at which said image forming unit starts image formation in a direction perpendicular to a direction in which said medium passes through said image forming unit.

19. The image processing apparatus according to claim 14, wherein:

said plurality of medium supply portions includes a first medium supply portion and a second medium supply portion;

when said control unit instructs said first medium storage portion to supply said medium, said control unit causes said image forming unit to start image formation, waits for an elapse of a medium supply waiting time, and then causes said first medium supply portion to start supplying said medium; and when said control unit instructs said second medium storage portion to supply said medium, said control unit causes said second medium supply unit to start supplying said medium, waits for an elapse of an image formation waiting time, and then causes said image forming unit to start image formation.

20. The image processing apparatus according to claim 14, wherein said plurality of medium supply portions include a first medium supply portion and a second medium supply portion;

wherein a distance by which said medium is supplied from said first medium supply portion to said image forming unit is a first distance;

wherein a distance by which said medium is supplied from said second medium supply portion to said image forming unit is a second distance which is different from said first distance; and wherein said control unit changes a timing at which one of said first and second medium supply portions starts supplying said medium and a timing at which said image forming unit starts image formation, based on one of said first and second distances corresponding to said medium supply portion instructed to supply said medium.

21. An image processing apparatus comprising:

an image forming unit including a photosensitive body and configured to perform image formation and thereby forms an image on a medium by rotating said photosensitive body;

a plurality of medium supply portions for supplying the medium to said image forming unit, said plurality of medium supply portions including a first medium supply portion and a second medium supply portion; and a control unit that instructs one of said plurality of medium supply portions to supply the medium, and instructs said image forming unit to perform image formation;

wherein when said control unit starts an operation to form an image on said medium after receiving printing data, said control unit changes a timing to start rotating said photosensitive body to form the image, based on which of said plurality of medium supply portions is instructed to supply the medium;

wherein said control unit controls a timing to start rotating said photosensitive body and a timing to start supplying said medium by said one of said plurality of medium supply portions at different timings, based on which of the first medium supply portion and the second supply portion is instructed to supply said medium;

wherein in the case in which said first medium supply portion is instructed to supply said medium, the timing to start supplying said medium by said first medium supply portion is earlier than the timing to start rotating said photosensitive body; and wherein in the case in which said second medium supply portion is instructed to supply said medium, the timing to start rotating said photosensitive drum is earlier than the timing to start supplying said medium by said one of said medium supply unit.

22. The image processing apparatus according to claim 21, wherein said control unit determines a difference between a timing at which said control unit instructs said one of said medium supply portions to start supplying said medium and a timing at which said control unit instructs said image forming unit to start image formation, based on which of said medium supply portions is instructed to supply said medium.

23. The image processing apparatus according to claim 22, further comprising a storage unit that stores information on a time interval for each of said plurality of medium supply portions, said time interval being an interval between said timing at which said control unit instructs said one of said medium supply portions to start supplying said medium and said timing at which said control unit instructs said image forming unit to start image formation;

wherein said control unit determines said difference between said timing at which said control unit instructs said one of said medium supply portions to start supplying said medium and said timing at which said control unit instructs said image forming unit to start image formation by reading out information on said time interval corresponding to said medium supply portion instructed to supply said medium from said storage portion.

24. The image processing apparatus according to claim 23, wherein:

when said medium supply portion instructed to supply said medium is farther from said image forming unit, said control unit instructs said image forming unit to start image formation after said control unit instructs said medium supply portion to supply said medium; and when said medium supply portion instructed to supply said medium is closer to said image forming unit, said control unit instructs said medium supply portion to supply said medium after said control unit instructs said image forming unit to start image formation.

25. The image processing apparatus according to claim 21, wherein:

said plurality of medium supply portions includes a first medium supply portion and a second medium supply portion;

when said control unit instructs said first medium storage portion to supply said medium, said control unit causes said image forming unit to start image formation, waits for an elapse of a medium supply waiting time, and then causes said first medium supply portion to start supplying said medium; and when said control unit instructs said second medium storage portion to supply said medium, said control unit causes said second medium supply unit to start supplying said medium, waits for an elapse of an image formation waiting time, and then causes said image forming unit to start image formation.

* * * * *